US006397795B2

(12) United States Patent
Hare

(10) Patent No.: US 6,397,795 B2
(45) Date of Patent: Jun. 4, 2002

(54) ENGINE WITH DRY SUMP LUBRICATION, SEPARATED SCAVENGING AND CHARGING AIR FLOWS AND VARIABLE EXHAUST PORT TIMING

(76) Inventor: Nicholas S. Hare, 177 Pineview Rd., Monroeville, AL (US) 35460

( * ) Notice: Subject to any disclaimer, the term of this patent is extended or adjusted under 35 U.S.C. 154(b) by 0 days.

(21) Appl. No.: 09/852,354

(22) Filed: May 10, 2001

Related U.S. Application Data

(60) Provisional application No. 60/213,860, filed on Jun. 23, 2000.

(51) Int. Cl.[7] ..... F02B 75/02
(52) U.S. Cl. ..... 123/65 PE
(58) Field of Search ..... 123/65 PE, 73 PP, 123/73 C, 73 B, 65 V, 196 M, 196 W, 73 A, 65 A

(56) References Cited

U.S. PATENT DOCUMENTS

| | | | | |
|---|---|---|---|---|
| 872,622 | A | | 12/1907 | Hagadorn |
| 920,165 | A | | 5/1909 | Marcil |
| 934,125 | A | | 9/1909 | Young |
| 1,096,819 | A | | 5/1914 | Ahlberg |
| 1,136,715 | A | | 4/1915 | Pitts |
| 1,486,110 | A | | 3/1924 | Hack |
| 1,569,030 | A | | 1/1926 | Randall |
| 1,582,195 | A | | 4/1926 | Vallier |
| 1,600,210 | A | | 9/1926 | Ashton |
| 1,791,971 | A | | 2/1931 | Penick et al. |
| 1,793,444 | A | | 2/1931 | Johnson |
| 1,895,728 | A | | 1/1933 | Pippin |
| 1,925,851 | A | | 9/1933 | Spencer |
| 1,949,612 | A | | 3/1934 | Mattair et al. |
| 1,972,732 | A | | 9/1934 | Farmer |
| 2,503,642 | A | | 4/1950 | Tilliet |
| 2,801,140 | A | | 7/1957 | Kretzer |
| 2,814,282 | A | | 11/1957 | Gross |
| 2,852,097 | A | | 9/1958 | Proctor |
| 2,937,631 | A | | 5/1960 | Coyle |
| 3,844,109 | A | | 10/1974 | Roos |
| 3,905,341 | A | | 9/1975 | Boyesen |
| 3,973,532 | A | | 8/1976 | Litz |
| 4,248,185 | A | * | 2/1981 | Jaulmes ..... 123/73 R |

(List continued on next page.)

OTHER PUBLICATIONS

SAE Paper No. 920779 entitled "Two Stoke Engines—The Lotus Approach" by Blundell et al. dated Feb. 24–28, 1992 (pp. 185–195).

SAE Technical Paper Series 850183 entitled "Improvement of fuel Consumption with Variable Exhaust Port Timing in a Two–Stroke Gasoline Engine" by Nomura et al, dated Feb. 25–Mar. 1, 1985 (pp. 1–10).

SAE Paper No. 730815 entitled "Exhaust Port Shapes for Sound and Power" by Johnston, dated Sep. 10–13, 1973 (pp. 1–10).

(List continued on next page.)

*Primary Examiner*—Marguerite McMahon
*Assistant Examiner*—Hyder Ali
(74) *Attorney, Agent, or Firm*—Synnestvedt & Lechner LLP

(57) ABSTRACT

An engine is disclosed having an improved lubrication system and scavenging system. An oil sleeve is positioned between the cylinder and the crankcase, the sleeve having a bore sized to receive the piston. The piston and sleeve define an annular oil space which is connected to a reservoir by oil lines. A fixed seal is positioned surrounding the piston between the cylinder and the oil sleeve. A movable seal is mounted on and surrounds the piston. On the power stroke the movable seal moves away from the fixed seal, drawing oil from the reservoir into the annular oil space. On the compression stroke, the movable seal moves toward the fixed seal, forcing the oil from the annular oil space into the piston wrist pin and through conduits to the crank and main bearings and then back to the reservoir. Separate scavenging and charging tubes connect the crankcase to the cylinder.

52 Claims, 12 Drawing Sheets

U.S. PATENT DOCUMENTS

| | | | | | |
|---|---|---|---|---|---|
| 4,250,844 | A | | 2/1981 | Tews | |
| 4,290,511 | A | | 9/1981 | de Baan et al. | |
| 4,294,202 | A | | 10/1981 | Boyesen | |
| 4,321,893 | A | | 3/1982 | Yamamoto | 123/65 PE |
| 4,364,307 | A | | 12/1982 | Paro | |
| 4,388,895 | A | | 6/1983 | Boyesen | |
| 4,395,978 | A | | 8/1983 | Boyesen | |
| 4,481,910 | A | | 11/1984 | Sheaffer | |
| 4,481,917 | A | | 11/1984 | Rus et al. | |
| 4,598,673 | A | * | 7/1986 | Poehlman | 123/73 PP |
| 4,630,591 | A | * | 12/1986 | Hooper | 123/73 PP |
| 4,829,946 | A | | 5/1989 | Boyesen | |
| 4,909,193 | A | | 3/1990 | Boyesen | |
| 4,911,115 | A | | 3/1990 | Boyesen | |
| 4,924,819 | A | | 5/1990 | Boyesen | |
| 5,002,025 | A | | 3/1991 | Crouse | |
| 5,396,867 | A | | 3/1995 | Ito et al. | |
| 5,513,608 | A | | 5/1996 | Takashima et al. | |
| 5,572,967 | A | | 11/1996 | Donaldson, Jr. | |
| 5,638,780 | A | | 6/1997 | Duvinage et al. | |
| 5,755,194 | A | | 5/1998 | Moorman et al. | 123/196 W |
| 5,983,851 | A | * | 11/1999 | Kimijima et al. | 123/196 M |
| 6,085,703 | A | | 7/2000 | Noguchi | |
| 6,112,708 | A | | 9/2000 | Sawada et al. | |
| 6,152,093 | A | | 11/2000 | Sawada et al. | |
| 6,216,650 | B1 | | 4/2001 | Noguchi | |
| 6,240,886 | B1 | | 6/2001 | Noguchi | |
| 6,289,856 | B1 | * | 9/2001 | Noguchi | 123/73 PP |

OTHER PUBLICATIONS

SAE Paper No. 700124 entitled "Parametric Studies Using a Two–Stroke Engine Cycle Simulation" by Sathe, dated Jan. 12–16, 1970 (pp. 1–12).

SAE Paper entitled "Design and Simulation of Two–Stroke Engines" by Blair, copyright 1996, Chapter 5 entitled "Computer Modeling of Engines" (pp. 363–370).

Popular Science (Feb. 1987) entitled "Can the two–stroke make it this time?" by Scott (pp. 74–76).

Popular Science (May 1999) article entitled Engines Two Strokes on Two Wheels by Carney (p. 45).

Popular Mechanics (Oct. 1999) article entitled "Outdoors Putting on The Pressure" by Gromer (pp. 48 and 50).

"Merc's All–New, Direct–Injected Outboard" by Barron, copyright 1996 (6 pages).

* cited by examiner

ENGINE WITH DRY SUMP LUBRICATION, SEPARATED SCAVENGING AND CHARGING AIR FLOWS AND VARIABLE EXHAUST PORT TIMING

RELATED APPLICATION

This application is based upon and claims the benefit of prior filed co-pending Provisional Application No. 60/213,860 filed Jun. 23, 2000.

FIELD OF THE INVENTION

This invention relates to improved internal combustion engines, and especially to two-stroke engines having improved lubrication, scavenging, charging and exhaust port timing to reduce polluting emissions and improve engine performance and fuel efficiency.

BACKGROUND OF THE INVENTION

The present invention recognizes the global need for reduced hydrocarbon emissions from small power-producing engines, especially as relates to the rapidly growing demand for agricultural and light industrial power in developing economies. In these economies, the low weight and low cost of two-stroke engines will be difficult to ignore, and it may be expected that two-stroke engines will be widely used. Two-stroke engines have inherently high levels of unburned hydrocarbon emission due to their operating principle, in which burned exhaust gases are expelled from the engine's cylinder at the same time that a fresh fuel/air charge is brought in, leading inevitably to mixing between the two and inadvertent expulsion of unburned charge with the exhaust gases.

Furthermore, two-stroke engines pass their fuel/air charge through the crankcase in order to allow a slight pressurization, caused by the descent of the piston, to assist the flow of charge into the cylinder. As it passes through the crankcase, the charge entrains lubricating oil droplets, which are splashed on the crankshaft main and rod end bearings and sprayed on the cylinder walls and wrist pin. (Alternately, oil is mixed with the fresh charge before entering the crankcase, in which case the charge is used as an agent for transporting oil to the surfaces requiring lubrication.) Lubricating oil entrained in the charge is inducted into the cylinder, where it either flows through into the exhaust, creating more unburned hydrocarbon emission, or stays in the cylinder and is burned, creating a more noxious set of pollutants than would stem from the combustion of the engine fuel itself.

The pollution disadvantages of conventional two-stroke, spark-ignited engines (overlap of intake and exhaust flows and crankcase charge compression) lead to its advantages in day-to-day applications. Since the exhaust and intake strokes are not separate, for a given requirement for engine power and speed, at a gas constant compression ratio, a two-stroke engine requires only half the displacement of a four-stroke engine. The weight of the two-stroke engine would also be little more than half of the weight of a power-equivalent four-stroke engine and cost much less to produce. These advantages will prove very difficult to ignore in a developing economy, and thus, if two-stroke engines retain their conventional form, there is a great potential for globally significant increases in engine-related air pollution.

The present invention retains the engine size advantage of the two-stroke engine, the cost advantage of the carbureted two-stroke engine and reduces its unburned hydrocarbon emissions and lubricating oil combustion characteristics to levels comparable with the most advanced direct injected, two-stroke, dry-sump engines. This is accomplished with a relatively minor increase in cost for the inclusion of new parts and new machined or cast features on conventional parts. These parts and features allow the present invention, an improved two-stroke, spark-ignited engine, to operate with very little unburned fuel emission and with very little lubricating oil combustion.

SUMMARY AND OBJECTS OF THE INVENTION

Nearly complete reduction in unburned fuel emission is achieved in the invention by separating the air flow from the crankcase to the cylinder into two separate tubes. One tube contains air only and scavenges the burned gas out of the cylinder through the exhaust port. The top of the port for this scavenging tube is located relatively high on the cylinder wall and is uncovered sooner on the piston down-stroke. The other tube contains air and fuel and charges the cylinder. The top of the port for the charging tube is located relatively lower on the cylinder wall and is uncovered later on the piston down-stroke than the scavenging tube port. This timing of the ports will allow the air-only scavenging flow time to purge the cylinder of burned gas before the air/fuel charge flow is initiated. Fuel will not be mixed with air on inlet to the crankcase, as is the case in conventional two-stroke spark-ignited engines, but rather is mixed on the passage from the crankcase to the cylinder through the charging tube. Fuel is mixed with air only on its passage through this charging tube and not on its passage through the scavenging tube.

Not all of the scavenging air is exhausted from the cylinder, and the remainder is mixed with the air/fuel charge. Therefore, in order to maintain an appropriate overall air/fuel ratio in the cylinder, the charging air/fuel mixture must be rich in fuel. This rich charge can be directed, with appropriate port and tube design, towards the spark plug. Combustion is then initiated, at the plug, in a rich mixture (mostly rich charge and a little scavenge air) and burns out, away from the plug, into a lean mixture (mostly scavenge air and a little rich charge). This is precisely the principle behind stratified charge ignition, a widely recognized enhancement to combustion efficiency, pollution reduction and engine cycle efficiency. This sort of rich-lean combustion cannot be achieved in a conventional two-stroke, spark-ignited engine. It is achievable in the present improved two-stroke, spark-ignited engine because of the novel features of the invention. This advantageous form of combustion is also achievable using advanced, direct-injected, two-stroke engine technology; however, direct injection of fuel into the cylinder is costly, and such a system would be difficult to acquire and maintain in a developing economy. The present invention allows the advantages of stratified combustion while using only easily achieved, relatively low-cost technologies.

A further achievement of the invention's separated charging and scavenging flows is that the engine may be controlled by throttling only the charging flow. As a result, the present improved two-stroke spark-ignited engine will have higher partial-load efficiency than conventional two-stroke spark-ignited engines. Conventional spark-ignited engine control is achieved by throttling the intake flow, which reduces the amount of fuel entering the engine and also reduces the amount of air intake. These reductions are achieved by partially blocking (throttling) the intake flow, leading to large pressure drops in the intake flow and reduced engine efficiency due to the piston-cylinder pumping power needed to overcome this pressure drop. In the present improved two-stroke, spark-ignited engine, intake flow is divided into separate charging and scavenging flows. At partial-load only the charging flow needs to be throttled, leaving the scavenging flow without any pressure drop, and reducing the total amount of pumping power needed at partial-load, thus, increasing the engine's efficiency. This advantage in engine efficiency is also achievable using advanced, direct-injected, two-stroke engine technology; however, direct injection is costly and would be difficult to acquire and maintain in a developing economy. The present invention allows high efficiencies while using only easily achieved, relatively low-cost technologies.

Nearly complete reduction in lubricating oil combustion is achieved in the invention by using a novel system for dry-sump lubrication, in which oil is circulated by piston pumping action (assisted by a crankshaft-mounted pump if necessary) from a reservoir that is segregated from the crankcase by seals. The oil passes through and lubricates bearings in the crankcase via a system of sealed passages or conduits. Oil is pumped through these conduits by the novel arrangement of an oil sleeve mounted between the cylinder and the crankcase, a fixed oil seal positioned between the oil sleeve and the cylinder and a moving oil seal mounted on the piston. An annular oil space is defined between the piston and the oil sleeve. A small, controlled amount of oil is allowed to escape past the fixed seal, up into the cylinder, in order to lubricate the compression rings and then be consumed, as is normal practice in engine design. The remainder of the oil is circulated by the pumping action of the moving seal against the fixed seal, which forces lubricating oil from the piston-cylinder annulus into the engine's internal passages, lubricating the wrist pin, the cylinder wall, the rod end bearings and the main bearing. (Alternately, the fixed seal may be a sealing ring as well, hence forcing all of the oil from the annular oil space into lubrication passages in the wrist pin; a small flow of oil to lubricate the compression rings may be drawn from the wrist pin through internal passages in the piston.) Oil returns from the main bearing to the reservoir to complete its cycle. The crankcase remains dry, separated by shaft seals from the oil reservoir.

In a conventional two-stroke engine, oil is either broadcast as a spray throughout the crankcase or inducted as a mist with the charge air. In both cases, the lubrication points are serviced by filling the entire crankcase with oil droplets. Many of these are inevitably inducted into the cylinder. In the lubrication system of the invention, oil is only distributed to surfaces where it is needed for lubrication, and oil droplets do not enter the charge air stream. Therefore, lubricating oil consumption is limited to small amounts spread on the cylinder walls and seeping through the piston ring gaps, as would be typical of a four-stroke engine. The lubrication system of the invention greatly reduces the excessive oil combustion and unburned emission of conventional two-stroke engines (especially at idle speeds), which has reduced two-stroke acceptance on environmental grounds. The invention's lubrication system makes the task of premixing oil and fuel unnecessary and avoids the loss of lubricating potential attendant to dilution with fuel. Employment of the invention should lead to a reduction in lubricating oil consumption, thereby lowering the operating cost of such engines. The lubricating system also reduces spark plug fouling and combustion chamber carbon deposits, because very little lubricating oil is burned in the cylinder. The reduction in oil consumption in the cylinder inherent in dry-sump lubrication might make it feasible to equip the present invention with a catalytic converter. Catalytic converters are not used on conventional two-stroke engines because they become fouled with oil emitted from the cylinder.

A variable exhaust port timing mechanism is incorporated into the engine according to the invention to further reduce any potential for emission of unburned hydrocarbons. As the piston descends on the power stroke, the exhaust port is the first port to be uncovered to initiate the blow-down process of releasing the cylinder pressure and initiating the exhaust flow. Therefore, the exhaust port upper lip is positioned highest in the cylinder of all the port lips, and for this reason, the exhaust port is also the last port to close. Even with good intake stratification and flow field tailoring, some fuel may be expected to flow out the exhaust port, as the piston rises after the charging and scavenging ports are sealed off. To inhibit this outward flow of fuel, a movable valve is incorporated into the exhaust port. This valve is lifted as the piston descends on the power stroke, thereby raising the position of the exhaust port upper lip and allowing early exhaust port opening. The valve is dropped before the piston's subsequent ascent on the compression stroke, lowering the effective position of the exhaust port upper lip and allowing early (as opposed to late) exhaust port closing. Early exhaust port closing is a particularly suitable feature in the present invention. Since the scavenging flow precedes the charging flow into the cylinder (unlike in conventional two-stroke engines, in which these flows are coincident), fuel density in the cylinder is lower earlier in the piston's cycle and higher later in its cycle. Therefore, if the exhaust port in the engine according to the invention is wider than in a conventional two-stroke engine but closes earlier, then it will only be open during periods of low fuel density, reducing the possibility of unburned fuel flowing out the exhaust port, while allowing the same total amount of exhaust flow.

In its preferred embodiment, the invention concerns an internal combustion engine having a piston reciprocable within a bore of a cylinder. The piston is pivotally connected to a crankshaft by a piston rod having a wrist pin at one end engaging the piston and a crank bearing at the opposite end engaging a throw of the crankshaft. The crankshaft is rotatably mounted on a main bearing within a crankcase positioned beneath the cylinder bore. An oil reservoir is mounted on the engine.

An oil sleeve is positioned between the cylinder and the crankcase, the oil sleeve having a bore therethrough coaxially aligned with the cylinder bore and sized to receive the piston. The piston is reciprocable within the oil sleeve bore. An annular oil space is defined between the piston and the oil sleeve.

A first seal is positioned between the cylinder and the oil sleeve, the first seal circumferentially surrounding the piston and permitting a predetermined amount of oil to flow from the annular oil space to the cylinder bore for lubricating the piston within the cylinder. A second seal is mounted on and circumferentially around the piston between the wrist pin and the crankshaft, the second seal having an outer circumference engaging the oil sleeve to substantially prevent oil within the annular oil space from flowing into the crankcase. A first conduit extends between the oil reservoir and a first port within the oil sleeve in fluid communication with the annular oil space. The first port is positioned so as to always be between the first and second seals regardless of the position of the piston within the cylinder bore and the oil sleeve bore. A check valve is mounted within the first conduit to prevent oil back flow from the annular oil space to the reservoir.

A second conduit extends along the wrist pin from a port in fluid communication with the annular oil space to the piston rod and along the piston rod to the crank bearing and from the crank bearing to the main bearing and then to the oil reservoir. Upon motion of the piston moving the second seal away from the first seal, lubricating oil is drawn from the oil reservoir through the first conduit and into the annular oil space to lubricate the piston. Upon further motion of the piston moving the second seal toward the first seal, lubricating oil within the annular oil space is forced through the second conduit back to the oil reservoir in a closed loop circulation, thereby lubricating the wrist pin, the crank bearing and the main bearing.

It is an object of the invention to provide an improved internal combustion engine with reduced hydrocarbon emissions.

It is a further object of the invention to provide a two-stroke or a four-stroke engine which will operate in any position, attitude or orientation.

It is another object of the invention to provide an improved engine having increased fuel and oil economy.

It is another object of the invention to provide a two- or four-stroke engine having a dry-sump lubrication system.

It is another object of the invention to provide a two-stroke engine having a scavenging air flow separate from a charging flow.

It is another object of the invention to provide a two-stroke engine with a stratified charge, having a relatively rich mixture near the spark plug.

It is another object of the invention to provide a two-stroke engine wherein the charging flow is throttled.

It is another object of the invention to provide a method of operating a two-stroke engine wherein the scavenging flow occurs before the charging flow.

It is another object of the invention to provide an engine wherein the piston pumps oil from a reservoir to lubricate the engine.

It is another object of the invention to provide an engine having variable exhaust valve timing.

These as well as other objects and advantages of the invention will become apparent from consideration of the following drawings and detailed description of the preferred embodiments of the invention.

DETAILED DESCRIPTION OF THE PREFERRED EMBODIMENT

By way of example only, the illustrated embodiment of the present invention addresses a single-cylinder, single main bearing, two-stroke, spark-ignited, loop-scavenged, over-square (bore to stroke ratio 2.38) engine of about 126 cubic centimeters gas displacement. However, the principles according to the invention of separated scavenging and charging tubes, charging tube fuel mixing, rich-lean combustion by arrangement of separated scavenging and charging tubes and ports, increased partial-load efficiency by throttling only a rich charging flow, variable exhaust port timing and piston-pumped distribution of lubricating oil in a dry-sump system have useful application in all other two-stroke, spark-ignited and compression-ignited engine types. The dry-sump lubricating system also has useful application in four-stroke engines in which a dry sump is advantageous, such as hand-held power tools and aircraft engines.

DESCRIPTION OF THE ENGINE ACCORDING TO THE INVENTION

Figure 1:
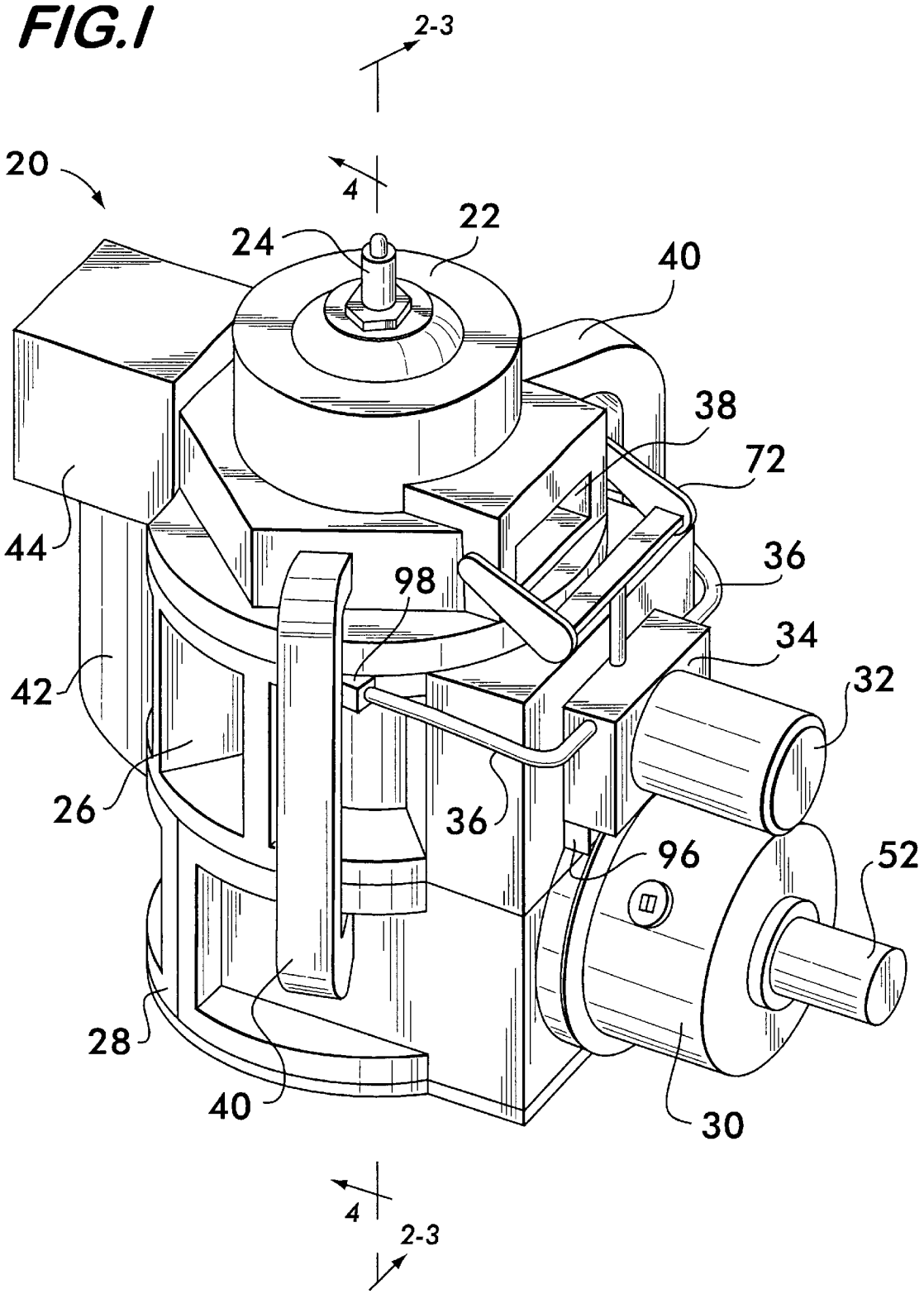
FIG. 1 is an external perspective view of an engine according to the invention.

FIG. 1 shows an external view of an engine 20 according to the invention. Engine 20 comprises a cylinder 22 in which a spark plug 24 is mounted. An oil sleeve 26 is positioned immediately beneath the cylinder 22 and a crankcase 28 is attached to the oil sleeve. Preferably, an oil reservoir 30 for holding lubricating oil is mounted on crankcase 28. Associated with the oil reservoir are an oil filter 32, an oil distribution manifold 34 and oil lines 36 connecting the manifold 34 with the oil sleeve 26.

Also visible in FIG. 1 is an exhaust port 38 in cylinder 22, two scavenging tubes 40 which connect the crankcase 28 and the cylinder 22, a charging tube 42 and a fuel metering device 44. Charging tube 42 connects the crankcase to the fuel metering device 44 which supplies fuel to the cylinder 22 during engine operation. Fuel metering device 44 is preferably a carburetor but could also be a manifold fuel-injector system.

Figure 2:
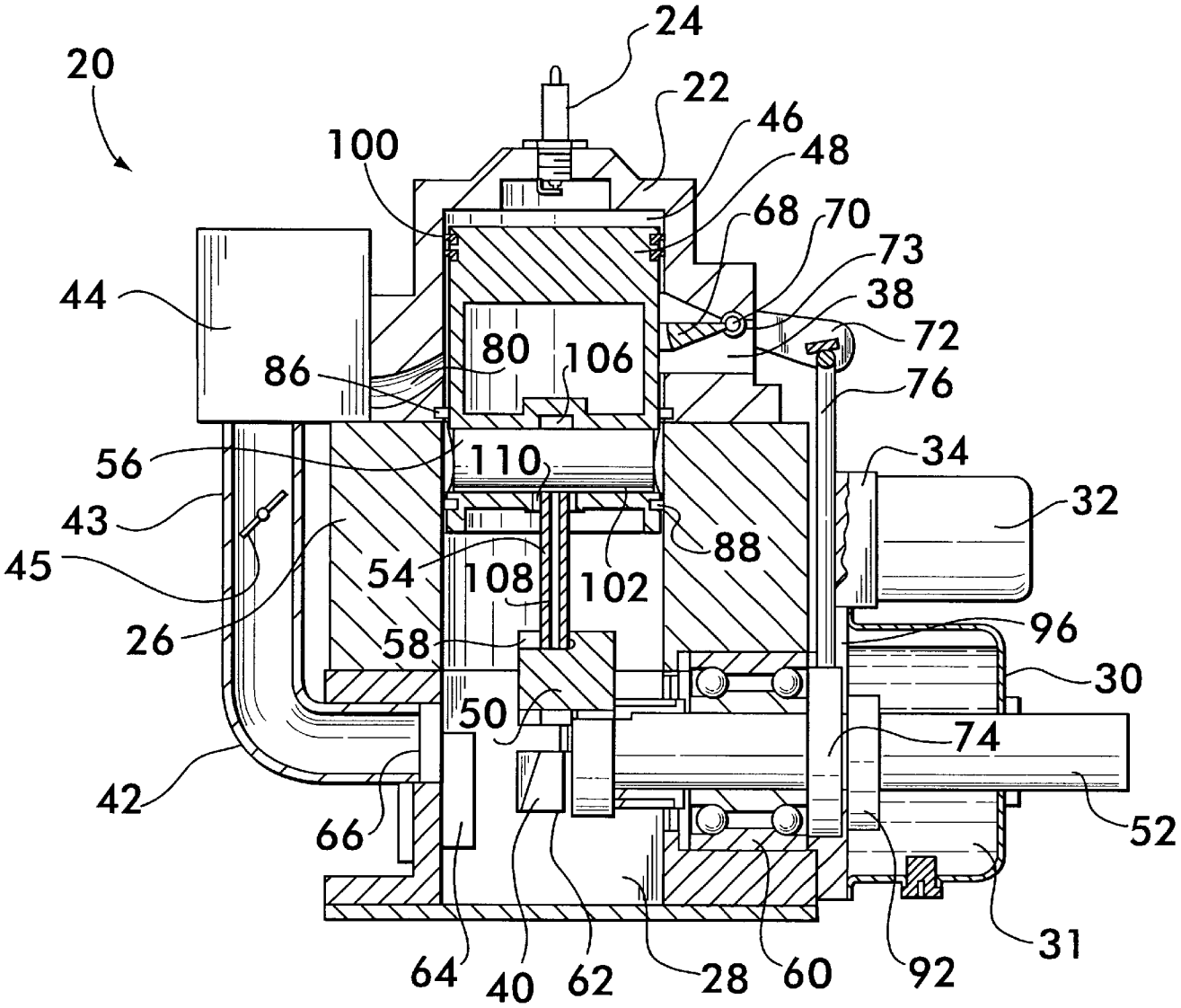
FIG. 2 is a sectional view taken along lines 2—2 of FIG. 1.

As shown in the sectional view of FIG. 2, cylinder 22 has a cylinder bore 46 which receives a piston 48 capable of reciprocal motion within the cylinder bore. Piston 48 is connected to a throw 50 of a crankshaft 52 by a piston rod 54. Piston rod 54 is pivotally connected to the piston 48 by means of a wrist pin 56 at one end and to the throw 50 of the crankshaft by a crankshaft bearing 58 at the other end. Crankshaft 52 is mounted in crankcase 28 on a main bearing 60.

Crankcase 28 has openings 62 (only one being shown) for each scavenging tube 40, allowing air from the crankcase to flow into the scavenging tubes and to the cylinder as described below. One-way valves 64 (again, only one being shown), preferably in the form of reed valves, are mounted in the crankcase to allow ambient air to enter and replace the air which flows to the cylinder. The crankcase has a further opening 66 which allows air from the crankcase to flow into the charging tube 42.

Preferably, exhaust port 38 has a gate valve 68 which is pivotally mounted on a shaft 70. The gate valve provides for variable timing of the opening and closing of the exhaust port 38 as described below and is operated by a lever 72 extending from the cylinder. Gate valve 68 may be manually set in one of two positions according to engine speed, or it may be variably positioned in proportion to engine speed by means of a cam 74 driven by crankshaft 52 and a cam follower 76 which connects the cam 74 to the lever 72. When cam 74 and cam follower are used to pivot gate valve 68 a biasing spring 73 is used to bias the gate valve into the upper most position, the cam and follower moving gate valve lever 72 against the spring 73 to position the gate valve in the lower position (shown).

Figure 3:
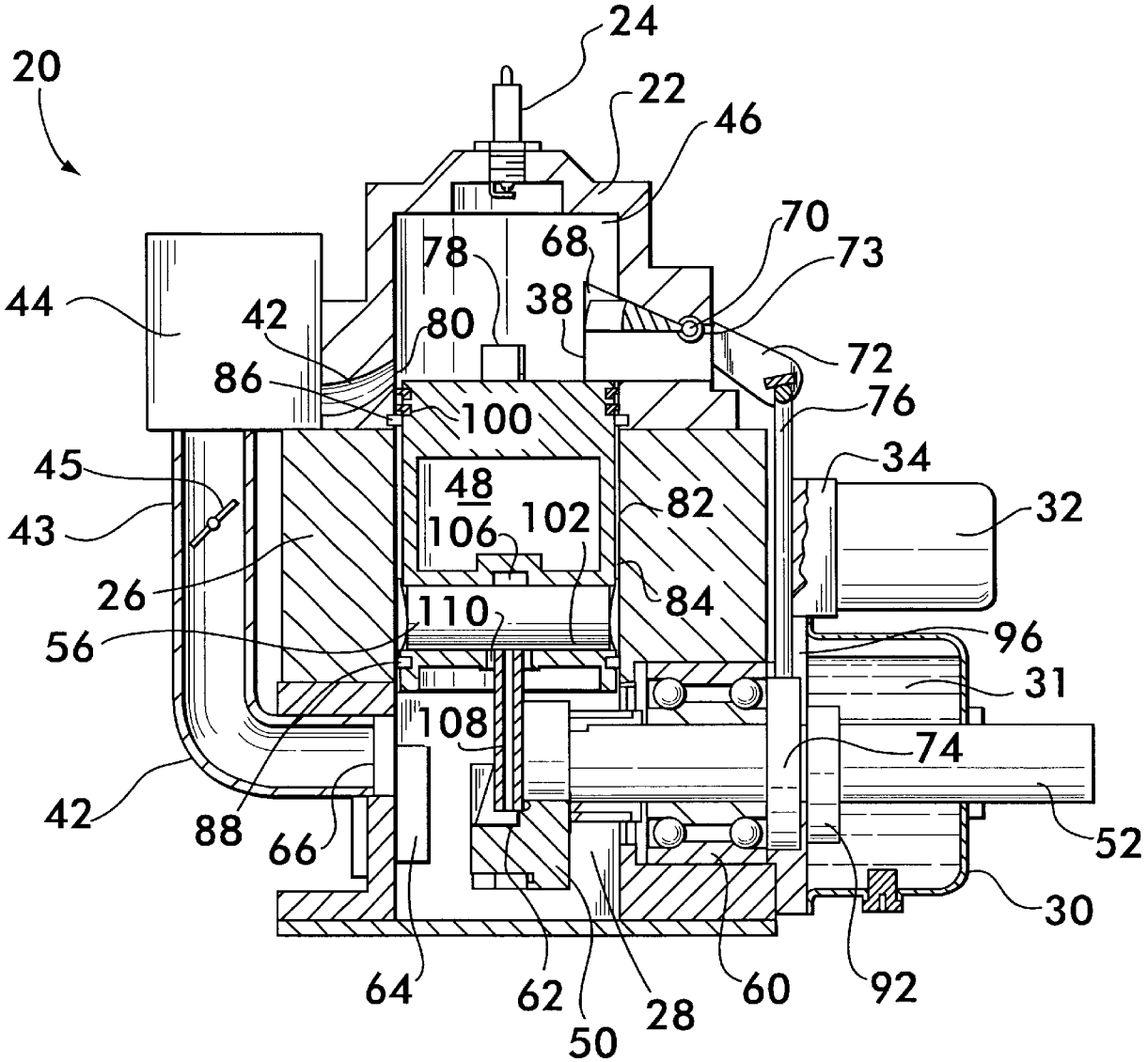
FIG. 3 is a sectional view taken along lines 3—3 of FIG. 1.
Figure 4:
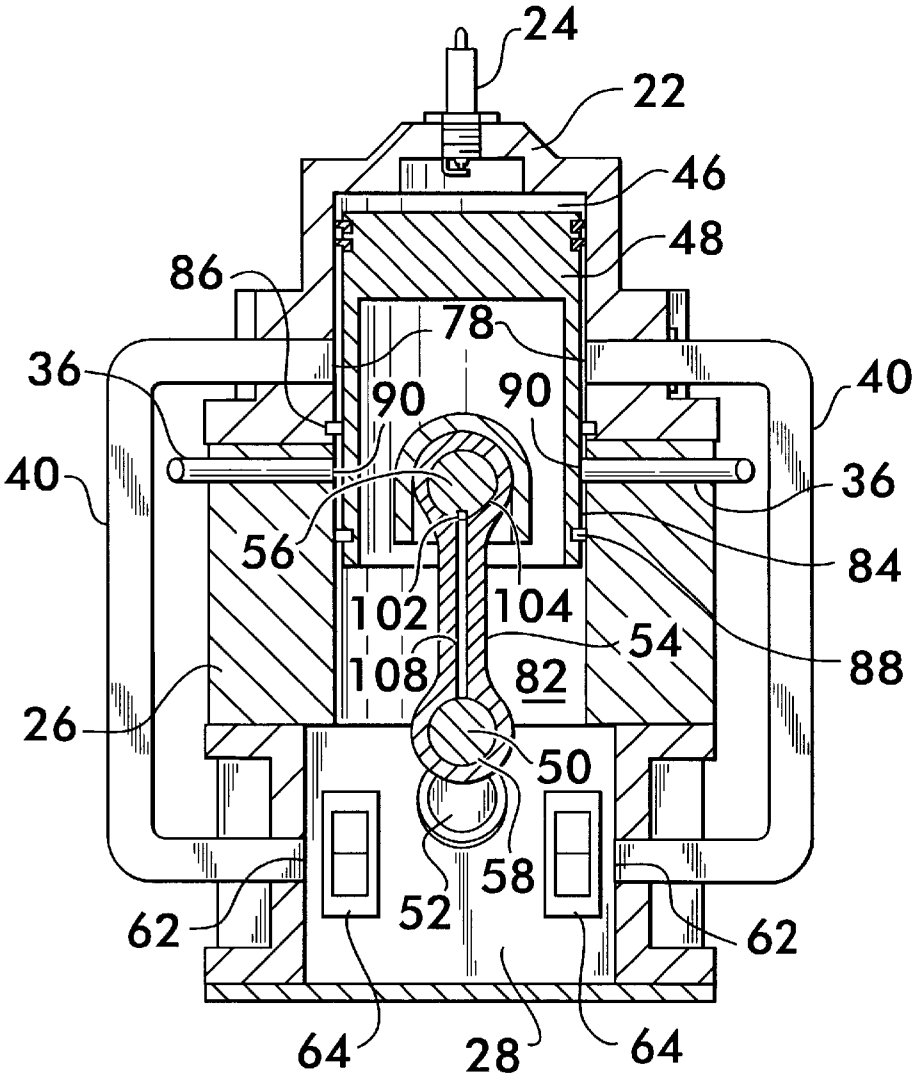
FIGS. 4 and 4*a* are sectional views taken along lines 4—4 of FIG. 1.

As best seen in FIGS. 3 and 4, cylinder 22 has scavenging ports 78 which connect to the scavenging tubes 40 allowing air from the crankcase 28 to flow through the scavenging tubes and into the cylinder. Preferably, the scavenging tubes 40 and the scavenging ports 78 are angularly oriented to point away from the exhaust port 38 (see FIGS. 1 and 9). This orientation is found to induce a looping flow of air within the cylinder to increase scavenging efficiency as described below. As shown in FIG. 3, a charging port 80 in cylinder 22 is connected to the fuel metering device 44 to allow a fuel-air charge to enter the cylinder during engine operation. Preferably, the charging port is oriented so as to direct the charge towards the spark plug 24 to develop a stratified fuel air mixture within the cylinder with a relatively rich fuel-air mixture positioned in the immediate vicinity of the spark plug.

As shown in FIG. 3, the oil sleeve 26, positioned between the cylinder 22 and the crankcase 28, has a bore 82 coaxially aligned with the cylinder bore 46 and sized to receive the piston 48 during its reciprocal motion. Oil sleeve bore 82 is also sized to form an annular oil space 84 between the oil sleeve and the piston 48. Annular oil space 84 acts as an oil reserve to provide lubricating oil to the piston as well as the wrist pin 56, the crank bearing 58 and the main bearing 60 as described below. Two seals keep the oil within the annular oil space 84. The first seal 86 is positioned between the cylinder 22 and the oil sleeve 26 and preferably comprises a ring-type seal which circumferentially surrounds the piston 48. First seal 86 is designed to allow a predetermined amount of oil from the annular oil space to the cylinder 22 to lubricate the piston 48 as it traverses the cylinder.

The second seal 88 is also preferably a ring-type seal and is mounted on the piston 48 between the wrist pin 56 and the crankshaft 52. Second seal 88 surrounds the piston and is designed to substantially prevent oil in the annular oil space 84 from entering the crankcase 28, thus, providing for a dry-sump lubrication system, unique when used with two-stroke engines.

In model prototype engines made to test the lubrication system according to the invention, the first and second seals 86 and 88 were rings of sintered bronze. While such seals provided adequate performance, it is thought that with further development seals of other materials, such as graphite compounds, or elastomerics such as rubber or more advance polymer may also prove feasible. The choice of seal material and design will largely depend upon the particular engine, its displacement, expected duty (light or heavy), cost, maintenance requirements and design life expectancy.

The first seal 86 is fixed and the second seal 88 reciprocates with the piston, thus, forming a pump which draws oil from the oil reservoir 30 on the power stroke and forces the oil through various conduits, described below, to lubricate the wrist pin 56, the crank bearing 58 and the main bearing 60 before returning to the oil reservoir 30. Oil is drawn through oil lines 36 (see FIG. 1) which connect the oil distribution manifold 34 to the oil sleeve 26. As best shown in FIG. 4, oil ports 90 in the oil sleeve 26, to which the oil lines 36 connect, are positioned in the sleeve so as to always be between the first and second seals 86 and 88 regardless of the position of piston 48. This ensures that no oil will enter the crankcase 28 and contaminate the air therein. If necessary, as shown in FIG. 3, a supplemental oil pump 92 may be provided to augment the flow of oil from the oil reservoir 30 to the annular oil space 84.

ENGINE OPERATION

Figure 6:
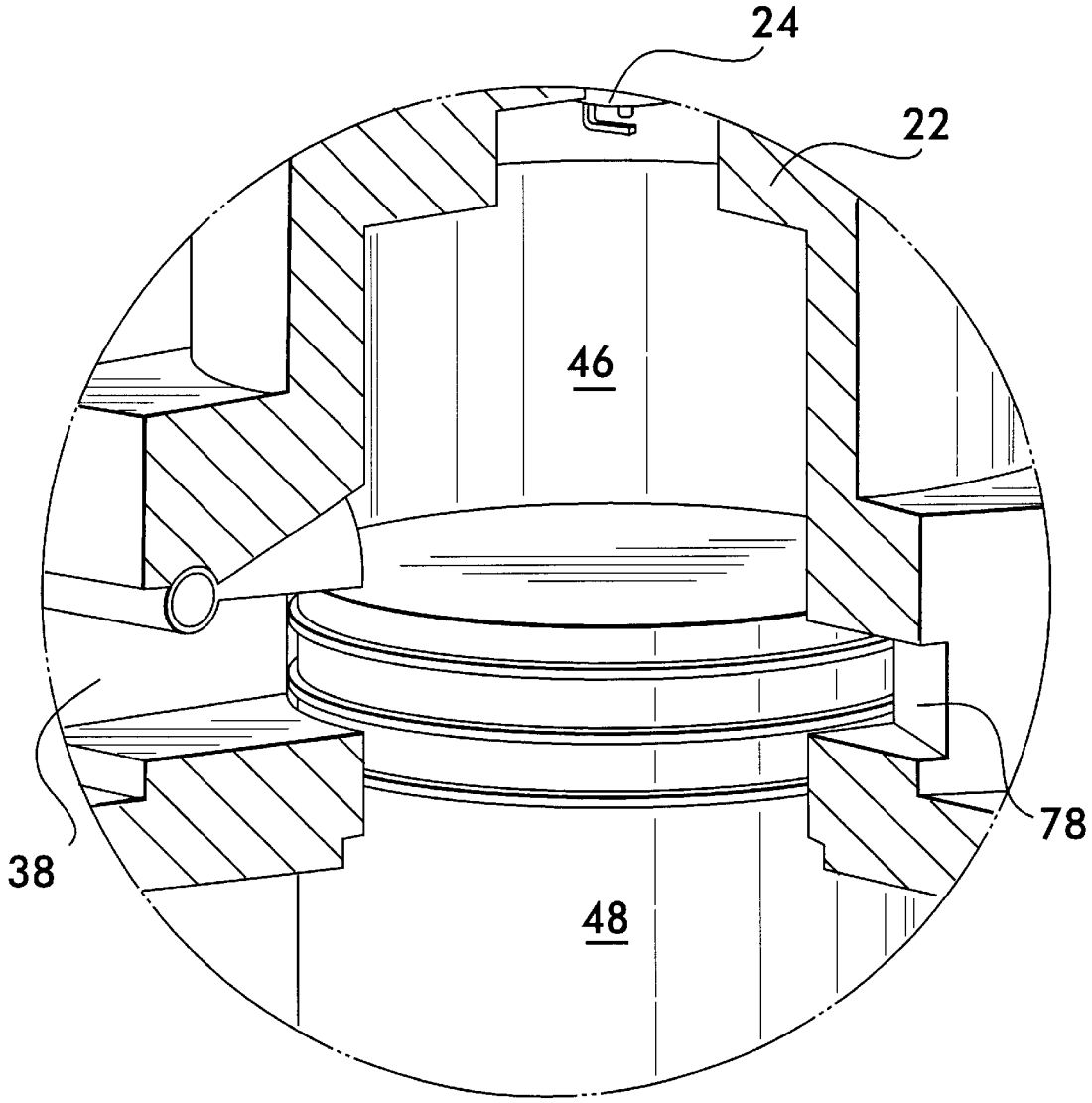
FIGS. 6–10 are partial cut-away views of a portion of the engine on an enlarged scale showing steps in engine operation.
Figure 7:
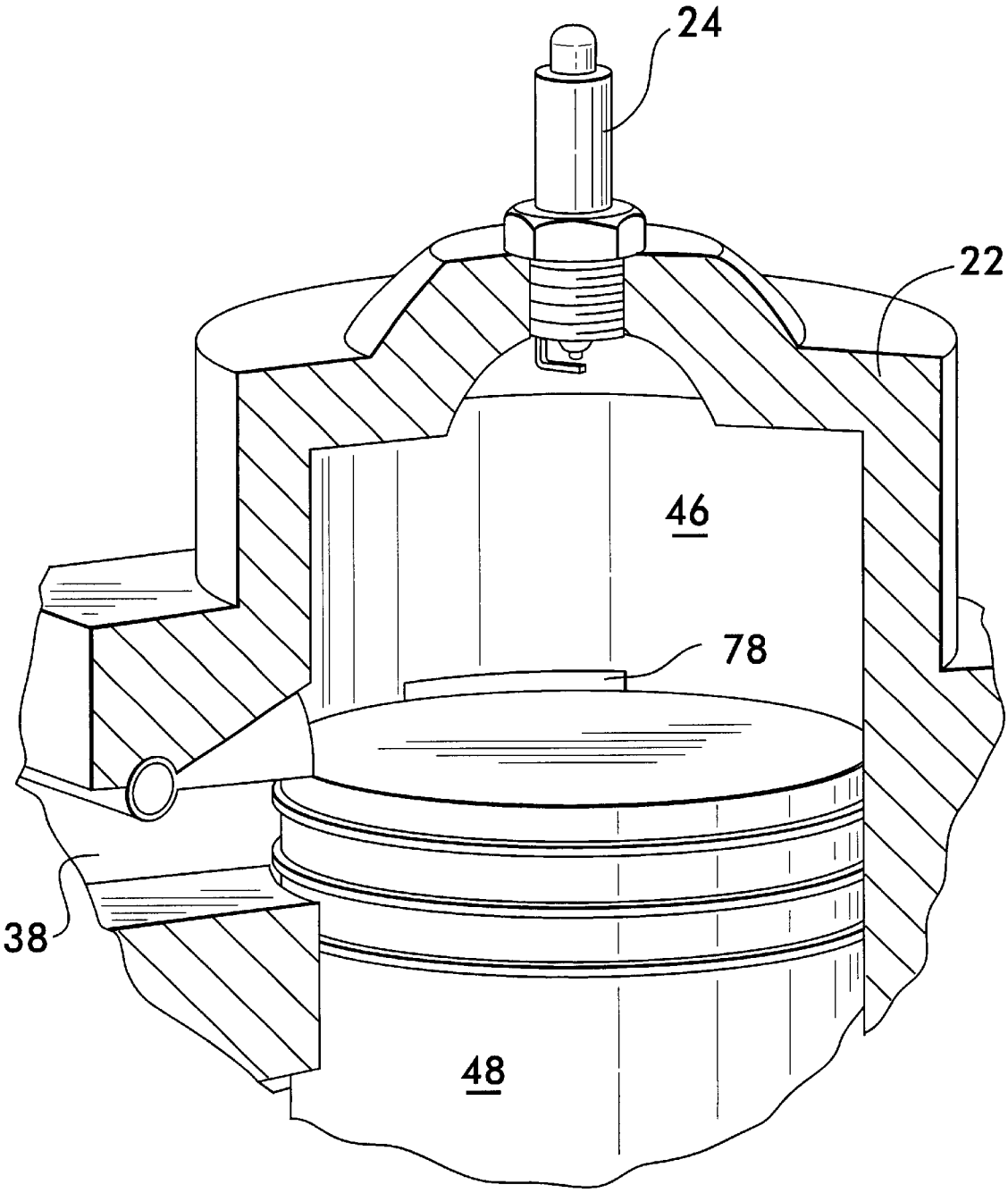
Figure 9:
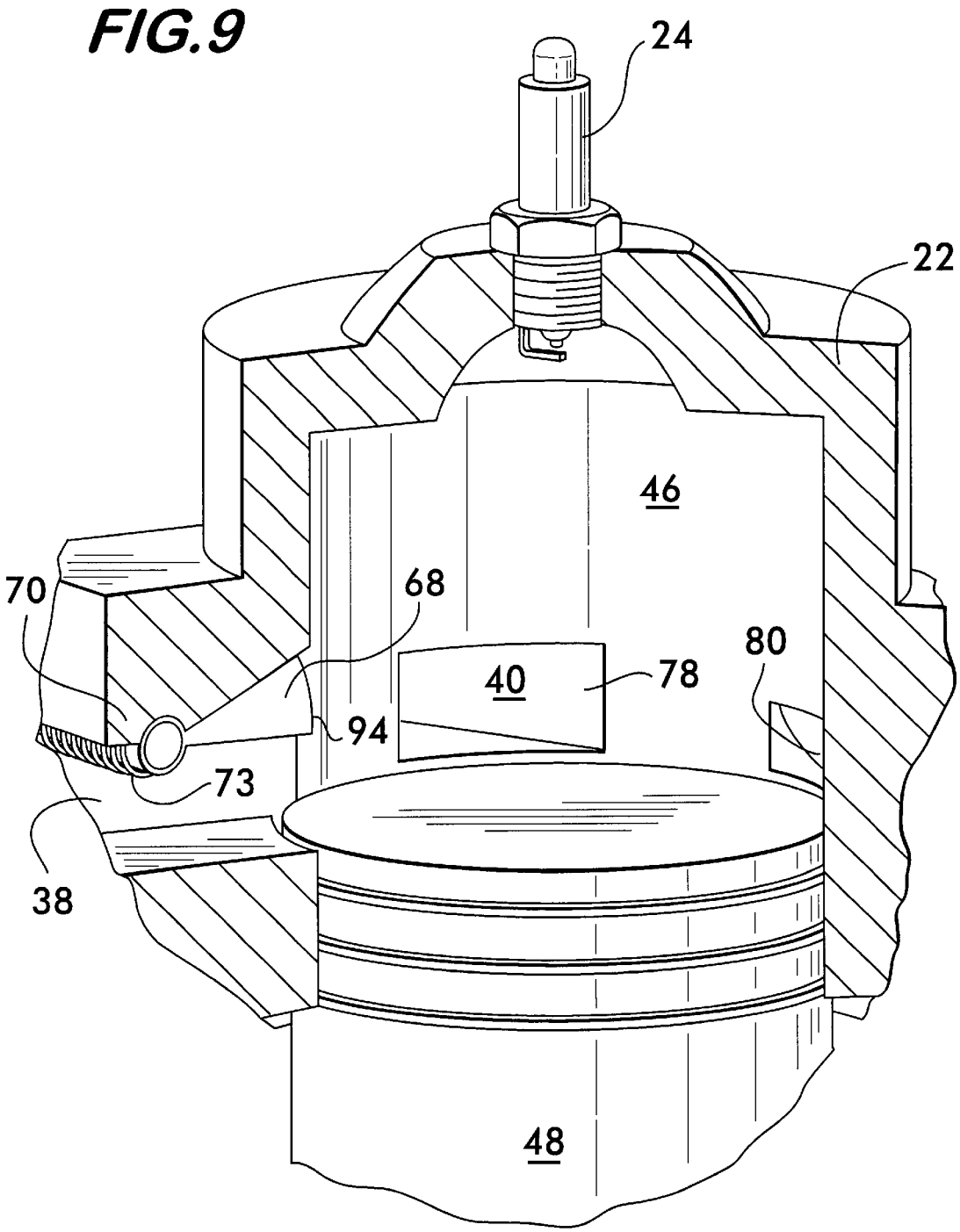

Power generating operation of the improved two-stroke, spark-ignited engine will be described by following an engine cycle. Starting with the piston 48 as shown in FIG. 2 at top center (crank angle 0°), shortly after the spark plug 24 has fired to initiate combustion in the cylinder 22, the piston 48 is driven down by the pressure of the burned and burning gas, turning the crankshaft 52. The descending piston 48 pressurizes the crankcase 28, closing the reed valves 64. At about 105° of crank angle (75° before bottom center), the exhaust port 38 in the cylinder 22 is uncovered (see FIG. 6) and pressure blowdown begins to occur. At about 120° of crank angle (60° before bottom center), the scavenging port 78 in the cylinder 22 is uncovered (see FIG. 7). Now air from the crankcase flows through the scavenging tube 40 and the scavenging port 78 as it is displaced out of the crankcase 28 by the descending piston 48. The scavenging flow partially mixes with, and partially displaces, the burned gas remaining in the cylinder 22 after blowdown, and drives this burned gas through the exhaust port 38. As shown in FIGS. 1 and 9, the scavenging tubes 40 and scavenging ports 78 are preferably oriented so as to direct the flow of scavenging air away from the exhaust port 38, thus, providing a looping flow of scavenging air which most efficiently clears the cylinder 22 of burned gas.

Figure 8:
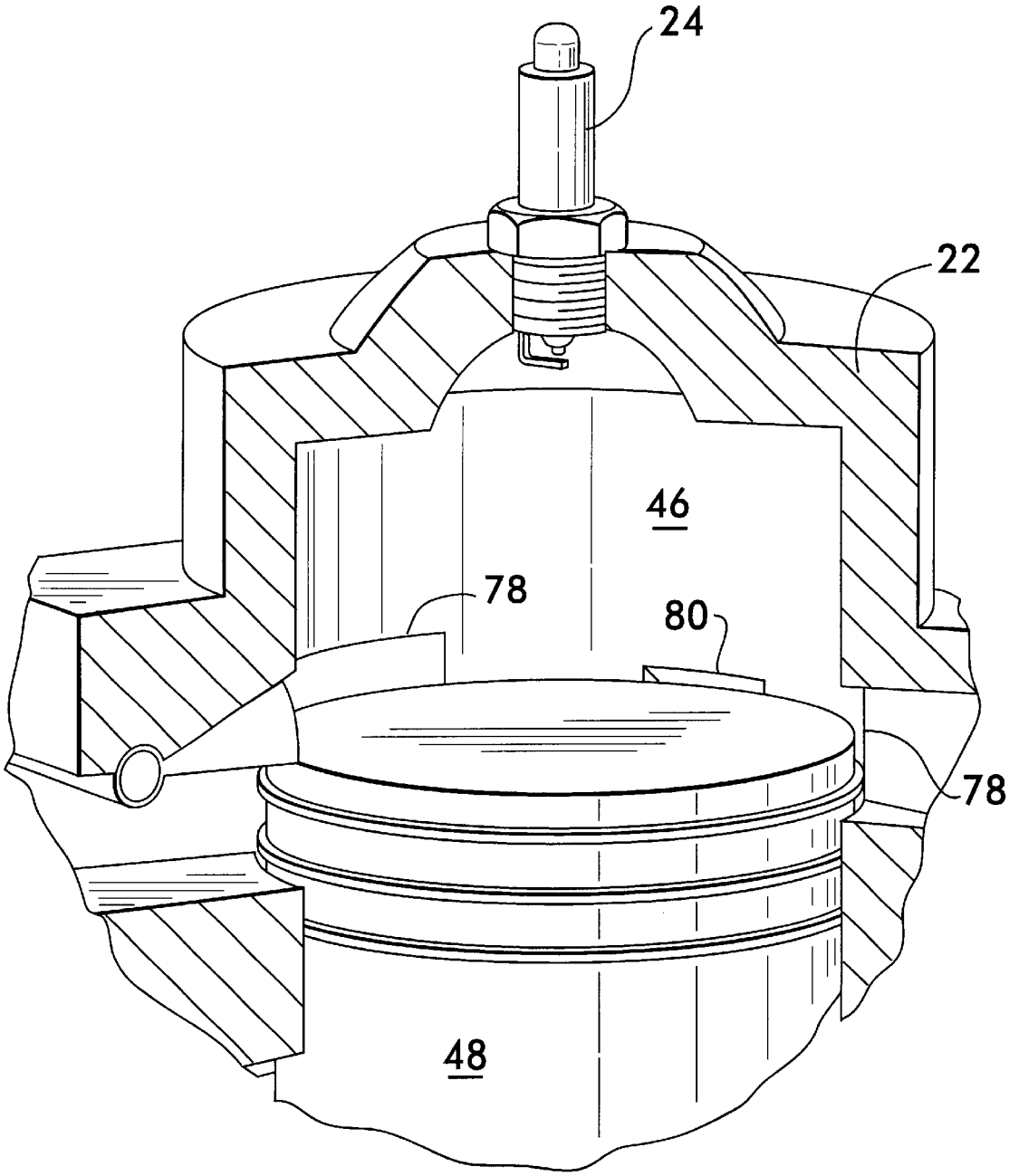

At about 135° of crank angle (45° before bottom center), the charging port 80 in the cylinder 22 is uncovered (see FIG. 8). As shown in FIG. 3, air from the crankcase 28 flows through the charging tube 42, and preferably passes through a throttle body 43 where it is regulated by a throttle valve plate 45, and then further through the fuel metering device 44, where it is mixed with fuel droplets. The fuel metering device 44 is calibrated to provide a rich air/fuel mixture in order that the overall proportions of fuel (from the fuel metering device 44 via the charging tube 42) and air (from the crankcase 28, via the scavenging tubes 40 as well as the charging tube 42) in the cylinder 22 are correct. After flowing through the fuel metering device 44, the charging air stream (now laden with fuel) continues through the charging tube 42 and enters the cylinder 22 through the charging port 80. The charging tube 42 and charging port 80 are preferably oriented as shown in FIG. 3 so that the charge flow is directed towards the spark plug 24 so as to obtain a locally rich air/fuel mixture at that point in the cylinder 22.

As burned gas and scavenging air continue to flow through the exhaust port 38, scavenging air continues to flow through the scavenging tubes 40, and fuel and air continue to flow through the charging tube 42, the piston 48 continues to descend to 180° of crank angle (bottom center, i.e., 180° after top center), and then begins to ascend. At about 225° of crank angle (135° before top center), the charging port 80 in the cylinder 22 closes and the charging flow stops. At about 240° of crank angle (120° before top center), the scavenging ports 78 in the cylinder 22 close and the scavenging flow stops. At about 255° of crank angle (105° before top center), the exhaust port 38 in the cylinder 22 closes and the exhaust flow stops. Compression of the air/fuel charge now begins, as the piston 48 continues to rise in the cylinder 22. The rising piston 48 pulls a vacuum in the crankcase 28 which opens the reed valves 64 and admits fresh air to the crankcase 28. Compression continues until 360° of crank angle (top center, see FIG. 4). The spark plug 24 fires at an appropriate advance before top center. The above sequence of events completes one engine cycle.

While fuel metering device 44 preferably uses a carburetor, it may also use an injector unit or a manifold fuel injection system, which would provide more precise control, though at greater expense. The concept of separated scavenging and charging air streams for reduction of unburned hydrocarbons in two-stroke, spark-ignited engines according to the invention exhaust works equally well for carbureted, injected, as well as manifold injected, fuel delivery.

The exhaust port 38 in the cylinder 22 is open during the entire time that the charging port 80 is open and fuel is flowing into the cylinder 22. The exhaust port 38 also remains open for a time after the charging port 80 in the cylinder 22 has closed. Thus, there is a potential for unburned fuel to flow out of the cylinder 22 through the exhaust port 38. This potential, known as imperfect trapping of fuel, is common to all conventional two-stroke engines in which unburned hydrocarbon emission is limited only by arranging the flow of incoming charge so that the action of displacement of the exhaust gas by the charge dominates the inevitable concurrent action of mixing of the charge with the exhaust gas. This technique, wherein the air-fuel charge displaces the exhaust gas in the cylinder during engine operation, is known as scavenging. Thus, in conventional two-stroke engines, some of the fuel charge inevitably flows unburned out of the exhaust port 38 (i.e., is not trapped) and some of the exhaust gas inevitably remains in the cylinder 22. In the present invention, unburned hydrocarbon emission is greatly inhibited (trapping efficiency is higher) because: (1) scavenging of exhaust gas is accomplished by a separated flow of air from the crankcase 28 which has no fuel or oil in it; (2) the scavenging flow precedes the charging (air/fuel) flow into the cylinder 22; and (3) mixing between the charge and the exhaust gas in the cylinder 22 is inhibited because this must take place through the intermediary of the scavenging air, and before any substantial mixing has time to occur, most of the exhaust gas will have been displaced out of the cylinder 22.

Note that there is no fuel in the scavenging flow because fuel is introduced only into the charging tube 42, and not upstream of the crankcase intake reed valves 64, as in conventional two-stroke engines. Furthermore, there is no oil in the scavenging flow because the engine according to the invention uses a dry-sump lubrication system (described below), not found in conventional two-stroke engines.

Imperfect trapping can still take place in the present invention because of the finite period between the covering of the charging port 80 and the covering of the exhaust port 38 on the upstroke of the piston 48, during which there is fuel in the cylinder 22, and the only opening into the cylinder 22 is through the exhaust port 38. However, trapping efficiency in the present invention is far superior to that in conventional two-stroke, engines because of the intermediary, fuel and oil-free scavenging air. Emission of unburned hydrocarbons by the present invention is, thus, nearly eliminated by: (1) delaying fuel mixing with the incoming air until after the air leaves the crankcase 28; (2) segregating the crankcase air into a fuel-free scavenging air flow and a fuel-laden charging air flow; and (3) arranging for the scavenging flow to precede the charging flow into the cylinder 22.

In prototype development, it may be found that the optimum timing for the opening and closing of the exhaust port 38 varies as a function of engine speed (rpm). Thus, instead of opening at 105° after top center and closing at 105° before top center regardless of engine speed, it may be found that earlier opening and later closing (for example, opening at 95° after top center and closing at 95° before top center) is more efficient at higher engine speed, allowing more time for effective blowdown and scavenging, though at the cost of a loss in compression ratio and power. Conversely, it may be found that later opening and earlier closing (for example, opening at 115° after top center and closing at 115° before top center) could be more efficient at lower engine speeds, in order to allow a higher effective compression ratio.

To take advantage of the functional relation between the timing of exhaust valve operation and engine speed to improve engine performance and efficiency, variable exhaust valve timing is employed.

Figure 10:
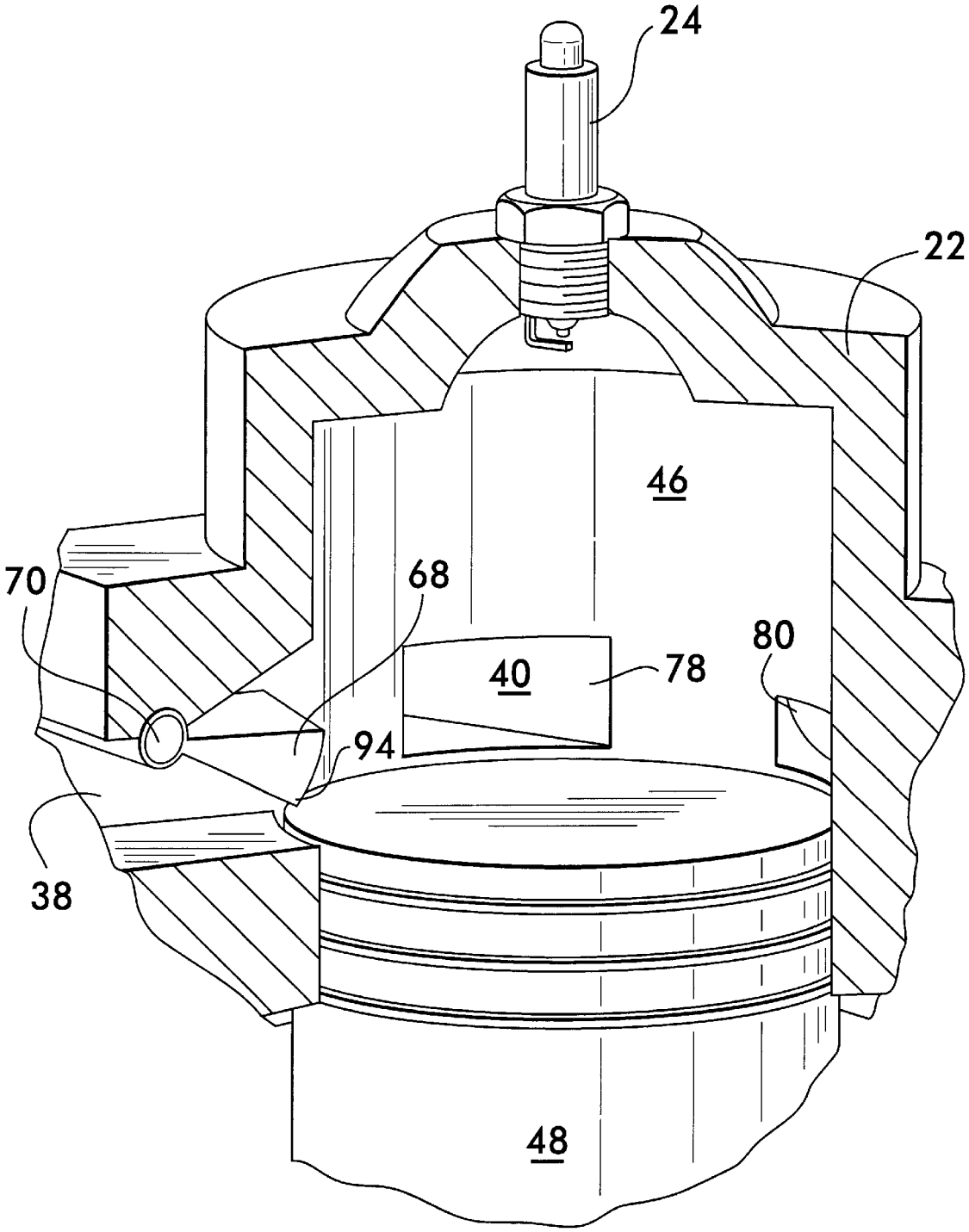

Variable exhaust valve timing is preferably effected through use of a movable exhaust port valve, such as pivoting gate valve 68, which increases or reduces the height of the upper lip 94 of exhaust port 38 to vary the timing of the exhaust port opening and closing. This is best shown in a comparison of FIGS. 9 and 10. FIG. 9 shows the gate valve 68 with the lip 94 in the uppermost position, and FIG. 10 shows the gate valve pivoted with the lip 94 in the lowermost position. (Eccentric spool valve embodiments may also be used in place of the gate valve.)

In the preferred embodiment of the invention, gate valve 68 is mounted within exhaust port 38 and pivots about shaft 70, actuated by a gate valve lever 72 (see FIGS. 1–3). The gate valve position may be set by manually adjusting the lever 72, with the valve setting chosen to suit the engine's speed of operation. In manual operation, the gate valve is preferably held in place by a detent mechanism (not shown). Alternatively, the gate valve lever 72 could also be linked with the throttle control through a systems of cranks and cables, so that an optimal position of the gate valve 68 for a particular engine speed could be obtained without attention from the engine operator.

Trapping efficiency may be even more improved in the present invention if the movement of gate valve 68 is automatically controlled by varying its position during each engine cycle. This would allow the gate valve to first be positioned in its uppermost position (FIG. 9) to permit exhaust port 38 to open at, for example, 95° after top center on the power stroke, and then be repositioned by pivoting downwardly (FIG. 10) to shut off the top portion of the exhaust port and permit it to close at 115° before top center on the compression stroke. This would allow a wider than normal exhaust port 38 to be open for a shorter than normal time, and may lead to less unburned fuel being lost through the exhaust port 38. Note that in the present invention, the fuel-laden charging flow arrives in the cylinder 22 later than it would in a conventional two-stroke engine, and hence there would be much less opportunity for the charge to escape through an open exhaust port 38 when variable exhaust port timing is in use.

As shown in FIGS. 2 and 3, automatic operation of the gate valve to effect variable exhaust port timing according to the invention is preferably achieved by a novel and simplified system of exhaust timing actuation through a crankshaft-mounted cam 74 operating a cam follower 76 connected to the gate valve operating lever. Biasing spring 73 returns the gate valve 68 to its upper most position between cam actuations. The many existing systems of variable exhaust ports are complicated and expensive to manufacture and maintain. The system here disclosed is simple and direct.

ENGINE LUBRICATION

As shown in FIGS. 1–3, lubricating oil 31 is supplied from the oil reservoir 30. An oil duct 96 connects the oil reservoir 30 to the oil distribution manifold 34 which directs the oil through an oil filter 32 and then to oil lines 36. Oil lines 36 connect the oil filter 32 to the oil sleeve 26. As shown in FIG. 4, oil lines 36 are in fluid communication with the annular oil space 84 though oil ports 90. Oil ports 90 are positioned within the oil sleeve 26 such that they are always between the first and second seals 86 and 88 regardless of the position of piston 48. For example, as illustrated in FIG. 4, the oil ports 90 may be positioned immediately below first seal 86. In this location, oil ports 90 should never be passed by the second seal 88 throughout the entire range of motion of piston 48.

Oil check valves 98, one of which is shown in FIG. 1, are preferably positioned in each of the oil lines 36 to allow oil to flow from the oil filter 32 into the oil sleeve 26 but prevent oil back flow. As shown in FIGS. 2 and 3, oil is contained in the annular oil space 84 between the piston 48 and the oil sleeve 26 by the first seal 86, fixed in position between the cylinder 22 and oil sleeve 26, and the second seal 88, which moves with piston 48. The first seal preferably acts as an oil ring and follows conventional oil ring practice, in that a controlled flow of oil is allowed past it in order to lubricate the cylinder 22 and the piston compression rings 100. (Alternately, the first seal may be a sealing ring, substantially blocking oil flow between the oil sleeve and cylinder and forcing all of the oil from the annular oil space into oil passages, described below, to lubricate the wrist pin. Oil from the wrist pin may then be directed through internal passages in the piston to lubricate the piston/cylinder interface.)

The second oil seal 88 draws from the less typical side of oil control ring technology, in that is designed to substantially prevent oil flow from the annular oil space 84 to the crankcase 28, thus, keeping the crankcase 28 free of lubricating oil and ensuring a dry sump. The seals may be made from a variety of different materials, but are preferably a rigid material, such as sintered bronze or one of various graphite compounds, as is presently the best practice in engine design, for reasons of an acceptable compromise between sealing performance and friction performance. Should application of a flexible material, such as rubber or advanced polymer prove acceptable from the friction and wear point of view, then sealing performance may be improved and ring installation would certainly be simplified.

As the piston 48 moves away from the spark plug 24 on the power stroke (compare FIGS. 2 and 3), the second seal 88 moves away from the first seal 86. The second seal 88 cooperates with the oil sleeve 26 and acts as a pump, drawing oil 31 from the reservoir 30, through the oil distribution manifold 34, through the oil filter 32, through the oil lines 36, through the oil ports 90 and into the annular oil space 84. Preferably, the oil ports 90 are positioned such that oil enters the annular oil space immediately adjacent to the first seal 86 as noted above.

Figure 5:
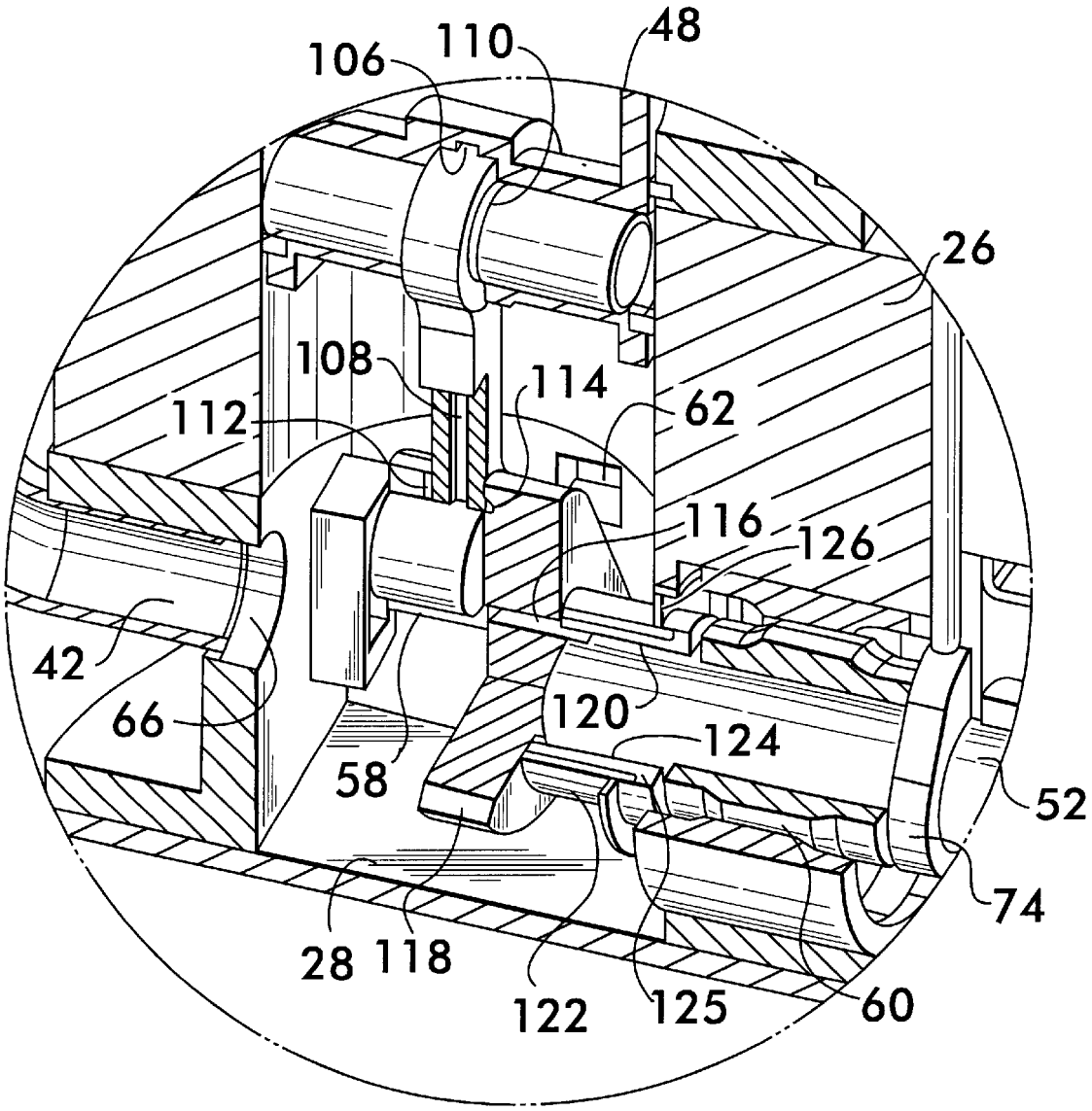
FIG. 5 is a partial cut-away view of a portion of the engine showing the lubrication system.

As the piston 48 moves toward the spark plug 24 on the compression stroke (compare FIGS. 3 and 2), the second seal 88 moves toward the first seal 86. With the oil lines 36 closed by the oil check valves 98, the piston movement forces oil from the annular oil space 84 into an oil groove 102 in the wrist pin 56 exposed to the annular oil space 84. This oil flow lubricates the wrist pin bearing 104 (see FIG. 4) connecting the piston rod 54 to the wrist pin. Oil from the groove 102 collects in a central groove 106 around the wrist pin 56. As shown in FIGS. 2 and 3, the central groove 106 communicates with a passage 108, extending along and preferably through the center of the piston rod 54. As best shown in FIGS. 3 and 5, a pair of piston rod seals 110 help contain the oil within the wrist pin bearing. Due to the operation of check valves 98, the piston rod seals 110, the first and second seals 86 and 88, as well as the position of second seal 88 between the wrist pin and the crankshaft, oil lubricating the wrist pin bearing 104 may only pass out of the oil sleeve via the passage in the piston rod 54. Oil does not seep into the crankcase 28.

Figure 11:
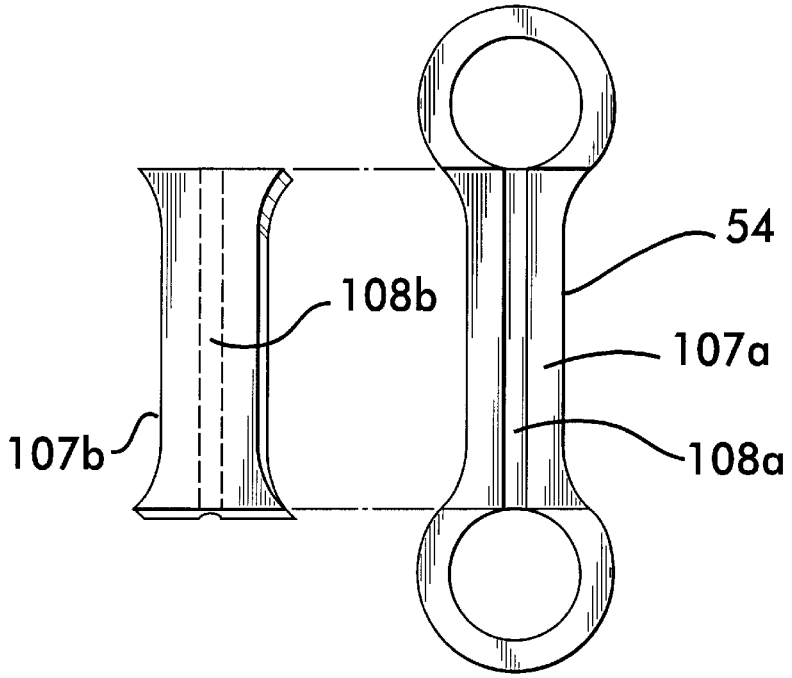
FIG. 11 shows an exploded view of a piston rod according to the invention.
Figure 12:
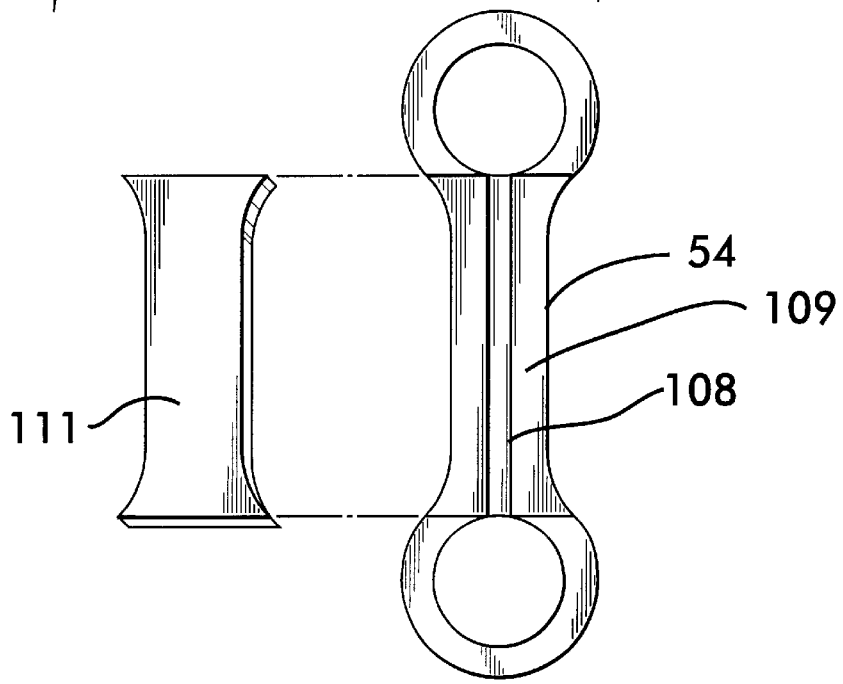
FIG. 12 shows an exploded view of another embodiment of a piston rod according to the invention.

As illustrated in FIG. 11, the piston rod 54 may be constructed of two mating portions 107*a* and 107*b* with facing grooves 108*a* and 108*b* to form the passage 108 on assembly. Alternately, as shown in FIG. 12, the piston rod 54 may be made from a single piece 109 having a groove 108 with a light cover 111 fixed along its length to close the open side of such a groove to form the passage. The cover may be a piece of sheet metal or foil, tightly wrapped around the piston rod 54 to make the groove 108 an oil-tight conduit. Lubricating oil will pass from the piston rod oil passage 108 to the piston rod crank bearing 58. Oil is contained within the crank bearing 58 by crank bearing oil seal 112 (see FIG. 5), so that oil does not seep into the crankcase 28. Oil flushing out of the crank bearing 58 will pass into a circumferential crank throw undercut 114, which communicates with a crankshaft oil passage 116 drilled through the crankshaft counterweight 118. The crankshaft oil passage 116 communicates with a crankshaft sleeve circumferential passage 120 cut around the inside of one end of the crankshaft sleeve 122. Oil passes along the crankshaft sleeve 122 through four crankshaft sleeve axial oil passages 124, and exits the crankshaft sleeve 122 through four crankshaft sleeve radial oil passages 125. The crankshaft sleeve radial oil passages 125 are separated from the crankcase 28 by the crankcase sleeve oil seal 126, so that oil does not seep into the crankcase 28. Oil exiting the crankshaft sleeve radial oil passages 125 will pass through the main bearing 60, lubricating it, before returning to the oil reservoir 30. This completes one complete cycle of the lubricating oil around the engine according to the invention. Since the wrist pin groove 102, central groove 106, piston rod passage 108, crank throw undercut 114, crankshaft passage 116, crankshaft sleeve circumferential passage 120 and crankshaft sleeve radial passages 123 are all in fluid communication with each other they may be considered to be a single conduit which allows oil to flow from the annular oil space 84 back to the oil reservoir 30 while lubricating the various engine components.

In an alternate embodiment, the oil which lubricates the crank bearing need not flow from it back to the reservoir. The reciprocating motion of the piston and the connecting rod will continually move or slosh oil throughout the various passages and grooves in the wrist pin and piston rod. This action avoids stagnation of the oil and carbonizing. If desired, oil can be flooded into and out of the piston through several openings in the piston body, removed from the annular oil space and discharged through oil lines 36 (without check valve 98) back to the reservoir.

Figure 4A:
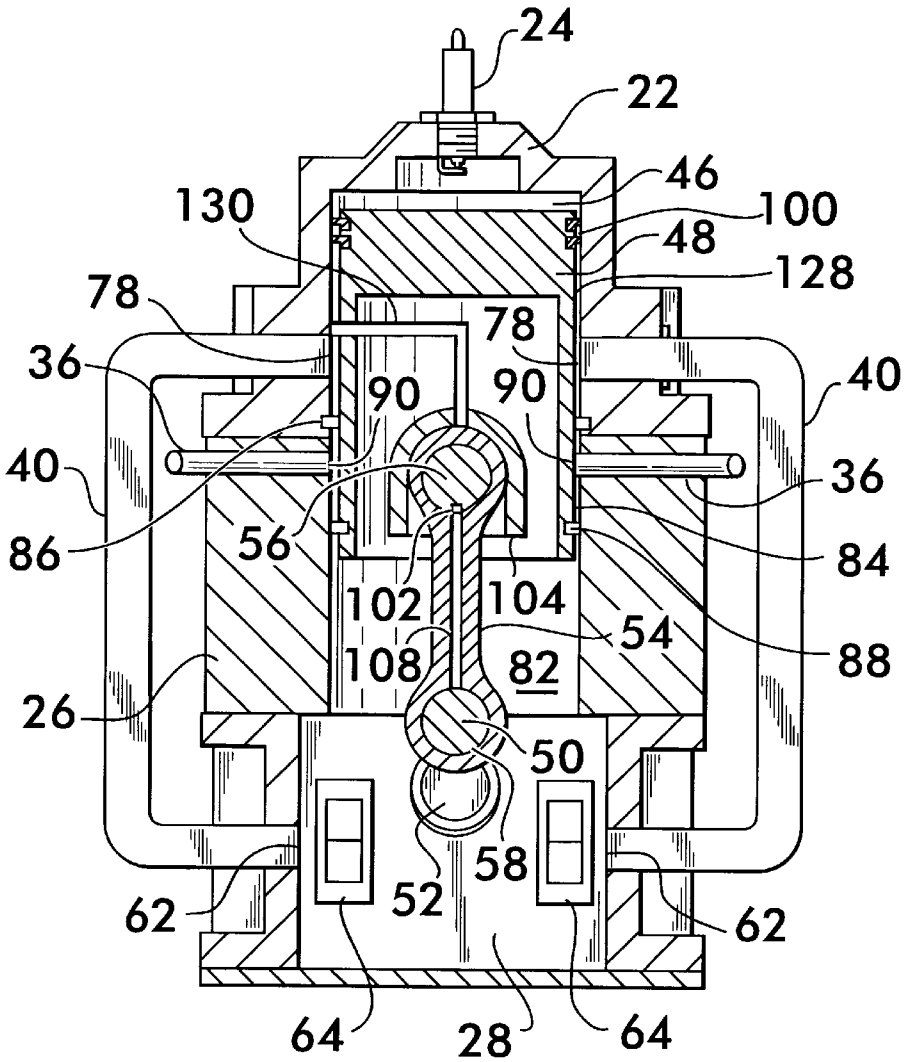

In another alternate embodiment, illustrated in FIG. 4*a*, oil ports 90 connected to oil lines 36 are positioned immediately above the first seal 86 and allow oil to flow directly into the annular space 128 between the piston 48 and the cylinder 22. Motion of the piston 48 again provides pumping action, this time due to the interaction of piston rings 100 and first seal 86. As piston 48 moves toward spark plug 24 on the compression stroke, oil rings 100 move away from first seal 86, drawing oil from the reservoir, through the filter 32 and manifold 34, oil lines 36 and oil ports 90 into the annular space 128. On the power stroke, rings 100 move toward the first seal 86, forcing the oil past the first seal into the annular oil space 84 (check valves 98 preventing back flow through oil lines 36) where it flows back to the oil reservoir 30, lubricating the various bearings as described above. Alternately, the oil could flow from annular space 128 through a duct 130 within the body of the piston to lubricate the wrist pin 56 and then flow onward as described above back to the reservoir, lubricating the other bearings.

In certain applications, sufficient oil may not be drawn from the reservoir 30 to the annular oil space 84 by the pumping action of the piston within the cylinder. For such situations, an auxiliary oil pump 92 is used. Auxiliary pump 92 is preferably positioned within the reservoir 30 and run from the crankshaft 52 to pump oil from the reservoir 30, through the oil distribution manifold 34, the oil filter 32, oil lines 36 and into the annular oil space 84.

It is noted that when the lubrication system according to the invention is applied to a four-stroke engine, considerably more crankcase charging volume and pressure can be achieved by adding, in the cylinder head, a pressure operated valve that opens automatically to admit ambient air into the cylinder, filling it during the intake stroke. The conventional intake valve in the cylinder, which is cam operated, is timed to open when the piston nears the bottom of the stroke, thus, topping off the air in the intake stroke with additional pressurized air.

This new lubrication system allows the crankcase to be charged with clean air which greatly reduces pollution in two-cycle engines and, if desired, can provide supercharging in four-cycle engines with little added cost by inducting the compressed air into the combustion chamber from the sealed crankcase. Air enters the crankcase through a one-way valve; the compressed air is forced into a holding chamber/intake manifold or transfer tube through a one-way valve, and the compressed air is inducted from the holding chamber into the combustion chamber through a conventional cam-operated combustion chamber intake valve. The holding tank is utilized to store the pressurized air and move it from the crankcase to the combustion chamber. Considerably more pressure/volume for supercharging can be obtained by adding a pressure-operated, one-way valve that opens automatically to admit ambient air into the combustion chamber during the intake stroke. This will fill the cylinder with air at ambient pressure. The conventional intake cam-operated valve is timed to open when the piston nears the bottom of the intake stroke so that the pressurized air enters the combustion chamber and tops off the air already in the cylinder with additional air and closing the automatic valve.

Thus, the lubrication system of the invention, unlike conventional engines (especially two-strokes) is a dry-sump system wherein the crankcase is substantially free of oil and therefore allows engine operation without the wasteful and polluting combustion of lubricating oil entering the cylinder from the crankcase.

For two- and four-stroke engines, the lubrication system according to the invention provides an oil-free crankcase which allows the engine to be operated in any position, attitude or orientation and is advantageous for hand-held tools, aircraft, etc. The first seal, fixed in position, is useful for both two- and four-stroke engines.

The engine according to the invention using: (1) separate scavenging and charging air flows; (2) a throttlable charging air flow; (3) a port opening sequence wherein the exhaust port opens, followed by the scavenging port opening, followed by a charging port opening; (4) variable exhaust port timing; in conjunction with (5) a dry-sump lubrication system having an oil sleeve positioned between the cylinder and the crankcase, promises to provide two-stroke engines having relatively low unburned hydrocarbon emissions, reduced lubricating oil combustion, and greater fuel and oil economy than conventional two-stroke engines currently in use.

What is claimed is:

1. An internal combustion engine having a piston reciprocable within a bore of a cylinder, said piston being pivotally connected to a crankshaft by a piston rod having a wrist pin at one end engaging said piston and a crank bearing at the opposite end engaging a throw of said crankshaft, said crankshaft being rotatably mounted on a main bearing within a crankcase positioned beneath said cylinder bore, an oil reservoir being mounted on said engine, said engine comprising:

an oil sleeve positioned between said cylinder and said crankcase, said oil sleeve having a bore therethrough coaxially aligned with said cylinder bore and sized to receive said piston, said piston being reciprocable within said oil sleeve bore, an annular oil space being defined between said piston and said oil sleeve;

a first seal positioned between said cylinder and said oil sleeve, said first seal circumferentially surrounding said piston and permitting a predetermined amount of oil to flow from said annular oil space to said cylinder bore for lubricating said piston within said cylinder;

a second seal mounted on and circumferentially around said piston between said wrist pin and said crankshaft, said second seal having an outer circumference engaging said oil sleeve to substantially prevent oil within said annular oil space from flowing into said crankcase;

a first conduit extending between said oil reservoir and a first port within said oil sleeve in fluid communication with said annular oil space, said first port being positioned so as to always be between said first and second seals regardless of the position of said piston within said cylinder bore and said oil sleeve bore;

a check valve mounted within said first conduit to prevent oil back flow from said annular oil space to said reservoir;

a second conduit extending through said piston from a second port in fluid communication with said annular oil space to said piston rod and along said piston rod to said crank bearing and from said crank bearing to said main bearing and then to said oil reservoir; and upon motion of said piston moving said second seal away from said first seal, lubricating oil being drawn from said oil reservoir through said first conduit and into said annular oil space to lubricate said piston, upon further motion of said piston moving said second seal toward said first seal, lubricating oil within said annular oil space being forced through said second conduit back to said oil reservoir in a closed loop circulation, thereby lubricating said wrist pin, said crank bearing and said main bearing.

2. An engine according to claim 1, wherein said first and second seals comprise rings of sintered bronze.

3. An engine according to claim 1, wherein said first oil port is positioned adjacent to said first seal.

4. An engine according to claim 1, wherein a portion of said second conduit comprises a groove arranged lengthwise along said wrist pin.

5. An engine according to claim 1, wherein a portion of said second conduit comprises a passageway extending lengthwise through said piston rod from said wrist pin to said crank bearing.

6. An engine according to claim 5, wherein said piston rod is formed of two elongated portions joined together along facing surfaces, at least one of said portions having a groove arranged lengthwise therealong, thereby forming said portion of said second conduit.

7. An engine according to claim 1, wherein said piston rod has a groove arranged substantially along its length and a cover positioned over said groove thereby forming a portion of said second conduit.

8. An engine according to claim 7, wherein said cover comprises sheet metal wrapped around said piston rod.

9. An engine according to claim 7, wherein said cover comprises a metal foil wrapped around said piston rod.

10. An engine according to claim 1, said engine being a spark plug ignited two-stroke engine having a fuel supply and an exhaust port in said cylinder, said engine further comprising:

a one-way valve positioned in said crankcase allowing ambient air to enter therein;

a scavenging port positioned in said cylinder substantially between said exhaust port and said crankcase;

a scavenging tube extending from said crankcase to said scavenging port and providing fluid communication between said crankcase and said cylinder bore;

a charging port positioned in said cylinder substantially between said scavenging port and said crankcase;

a charging tube extending from said crankcase to said charging port and providing fluid communication between said crankcase and said cylinder bore;

a fuel metering device receiving fuel from said fuel supply and positioned on said charging tube between said crankcase and said charging port;

during engine operation, said exhaust port being first uncovered upon a power stroke of said piston allowing exhaust gases to exit said cylinder bore, said scavenging port being next uncovered upon further motion of said piston, air within said crankcase being compressed by said piston and forced through said scavenging tube and entering said cylinder bore through said scavenging port thereby forcing exhaust gases out through said exhaust port, said charging port being next uncovered upon further motion of said piston, air within said crankcase being further compressed by said piston and forced through said scavenging tube and said charging tube, said air flowing through said fuel metering device and receiving a charge of fuel therefrom, said air and said fuel charge entering said cylinder bore through said charging port; and upon the compression stroke of said piston ambient air being drawn into said crankcase through said one way valve, said charging port first being covered by said piston, said scavenging port being next covered by said piston, and said exhaust port being finally covered by said piston, said air and fuel charge within said cylinder bore being compressed by said piston and ignited by said sparkplug to initiate a subsequent power stroke of said piston.

11. An engine according to claim 10, further comprising a throttle valve positioned within said charging tube, said throttle valve being adjustable to control the amount of fuel and air entering the cylinder bore.

12. An engine according to claim 10, wherein said fuel metering device comprises a carburetor.

13. An engine according to claim 10, wherein said fuel metering device comprises a fuel injector unit.

14. An engine according to claim 10, wherein said fuel metering device comprises a manifold fuel injector system.

15. An engine according to claim 10, wherein a portion of said scavenging tube adjoining said scavenging port is oriented angularly relatively to the diameter of said cylinder bore and in a direction pointing away from said exhaust port, thereby inducing looping scavenging flow to clear said cylinder bore.

16. An engine according to claim 10, wherein a portion of said charging tube adjoining said charging port is oriented in a direction pointing toward said spark plug, thereby forming a stratified charge within said cylinder bore.

17. An engine according to claim 10, further comprising a movable exhaust port valve pivotally mounted on said cylinder within said exhaust port, said exhaust port valve being pivotal between a first position partially blocking said exhaust port and thereby impeding the flow through said exhaust port, and a second position away from said exhaust port allowing unrestricted flow through said exhaust port, and a means for setting the position of said exhaust port valve in one of said first and said second positions.

18. An engine according to claim 17, wherein said setting means comprises a lever attached to said exhaust port valve for manually positioning said exhaust port valve in one of said first and second positions.

19. An engine according to claim 17, wherein said setting means comprises a cam and a cam follower mounted on said engine, said cam being driven by said engine, said cam follower being connected to said exhaust port valve and being reciprocably movable by said cam to pivot said exhaust port valve between said first and said second positions in proportion to engine speed, said exhaust port valve being in said second position during each exhaust stroke of said piston and moving into said first position blocking said exhaust port upon each compression stroke of said piston, said exhaust port valve thereby promoting trapping of said fuel and air charge in said cylinder bore.

20. An internal combustion engine having a piston reciprocable within a bore of a cylinder, said piston being pivotally connected to a crankshaft by a piston rod having a wrist pin at one end engaging said piston and a crank bearing at the opposite end engaging a throw of said crankshaft, said crankshaft being rotatably mounted on a main bearing within a crankcase positioned beneath said cylinder bore, an oil reservoir being mounted on said engine, said engine comprising:

an oil sleeve positioned between said cylinder and said crankcase, said oil sleeve having a bore therethrough coaxially aligned with said cylinder bore and sized to receive said piston, said piston being reciprocable within said oil sleeve bore, an annular oil space being defined between said piston and said oil sleeve;

a first seal positioned between said cylinder and said oil sleeve, said first seal circumferentially surrounding said piston to substantially prevent oil within said annular oil space from flowing into said cylinder;

a second seal mounted on and circumferentially around said piston between said wrist pin and said crankshaft, said second seal having an outer circumference engaging said oil sleeve to substantially prevent oil within said annular oil space from flowing into said crankcase;

a first conduit extending between said oil reservoir and a first port within said oil sleeve in fluid communication with said annular oil space, said first port being positioned so as to always be between said first and second seals regardless of the position of said piston within said cylinder bore and said oil sleeve bore;

a second conduit extending along said wrist pin from a second port in fluid communication with said annular oil space to said piston rod and along said piston rod to said crank bearing; and upon motion of said piston moving said second seal away from said first seal, lubricating oil being drawn from said oil reservoir through said first conduit and into said annular oil space to lubricate said piston, upon further motion of said piston moving said second seal toward said first seal, lubricating oil within said annular oil space being forced through said second conduit to lubricate said wrist pin and said crank bearing.

21. An engine according to claim 20, wherein said first seal is sized to permit a predetermined amount of oil to flow from said annular oil space to said cylinder for lubricating said piston within said cylinder.

22. An engine according to claim 20, wherein said second conduit extends along said crankshaft to said main bearing, said main bearing being lubricated by said oil from said annular oil space passing through said second conduit.

23. An engine according to claim 22, wherein said second conduit extends from said main bearing to said oil reservoir, said first conduit further comprising a check valve to prevent oil back flow from said annular oils space to said reservoir upon motion of said piston moving said second seal toward said first seal, oil from said annular oil space being forced through said second conduit back to said reservoir in a closed loop circulation.

24. An engine according to claim 22, wherein said piston rod has a groove arranged substantially along its length and a cover positioned over said groove, thereby forming a portion of said second conduit.

25. An engine according to claim 24, wherein said cover comprises sheet metal wrapped around said piston rod.

26. An engine according to claim 24, wherein said cover comprises a metal foil wrapped around said piston rod.

27. An engine according to claim 20, said engine being a spark plug ignited two-stroke engine having a fuel supply and an exhaust port in said cylinder, said engine further comprising:

a one-way valve positioned in said crankcase allowing ambient air to enter therein;

a scavenging port positioned in said cylinder substantially between said exhaust port and said crankcase;

a scavenging tube extending from said crankcase to said scavenging port and providing fluid communication between said crankcase and said cylinder bore;

a charging port positioned in said cylinder substantially between said scavenging port and said crankcase;

a charging tube extending from said crankcase to said charging port and providing fluid communication between said crankcase and said cylinder bore;

a fuel metering device receiving fuel from said fuel supply and connected to said charging tube between said crankcase and said charging port;

during engine operation said exhaust port being first uncovered upon a downstroke of said piston allowing exhaust gases to exit said cylinder bore, said scavenging port being next uncovered upon further motion of said piston, air within said crankcase being compressed by said piston and forced through said scavenging tube and entering said cylinder bore through said scavenging port thereby forcing exhaust gases out through said exhaust port, said charging port being next uncovered upon further motion of said piston, air within said crankcase being further compressed by said piston and forced through said scavenging tube and said charging tube, said air flowing through said fuel metering device and receiving a charge of fuel therefrom, said air and said fuel charge entering said cylinder bore through said charging port; and upon the upstroke of said piston ambient air being drawn into said crankcase through said one way valve, said charging port first being covered by said piston, said scavenging port being next covered by said piston, and said exhaust port being finally covered by said piston, said air and fuel charge within said cylinder bore being compressed by said piston and ignited by said spark-plug to initiate a subsequent downstroke of said piston.

28. An engine according to claim 27, further comprising a throttle valve positioned within said charging tube, said throttle valve being adjustable to control the amount of fuel and air entering the cylinder bore.

29. An engine according to claim 27, further comprising a gate valve pivotally mounted on said cylinder adjacent to said exhaust port, said gate valve being pivotal between a first position partially blocking said exhaust port and thereby impeding the flow through said exhaust port, and a second position away from said exhaust port allowing unrestricted flow through said exhaust valve, and a means for setting the position of said gate valve in one of said first and said second positions.

30. An engine according to claim 29, wherein said setting means comprises a lever attached to said gate valve for manually positioning said gate valve in one of said first and second positions.

31. An engine according to claim 29, wherein said setting means comprises a cam and a cam follower mounted on said engine, said cam being driven by said engine, said cam follower being connected to said gate valve and being reciprocably movable by said cam to pivot said gate valve between said first and said second positions in proportion to engine speed, said gate valve being in said second position during each exhaust stroke of said piston and moving into said first position blocking said exhaust port upon each compression stroke of said piston, said gate valve thereby promoting trapping of said fuel and air charge in said cylinder bore.

32. A lubrication system for a device having a piston reciprocable within a cylinder, said piston being pivotally connected to a crankshaft by a piston rod having a wrist pin at one end engaging said piston and a crank bearing at the opposite end engaging a throw of said crankshaft, said crankshaft being rotatably mounted on a main bearing within a crankcase positioned beneath said cylinder, an oil reservoir being mounted on said device, said device comprising:

an oil sleeve positioned between said cylinder and said crankcase, said oil sleeve having a bore therethrough coaxially aligned with said cylinder bore and sized to receive said piston, said piston being reciprocable within said oil sleeve bore, an annular oil space being defined between said piston and said oil sleeve;

a first seal positioned between said cylinder and said oil sleeve, said first seal circumferentially surrounding said piston and permitting a predetermined amount of oil to flow from said annular oil space to said cylinder bore for lubricating said piston within said cylinder;

a second seal mounted on and circumferentially around said piston between said wrist pin and said crankshaft, said second seal having an outer circumference engaging said oil sleeve to substantially prevent oil within said annular oil space from flowing into said crankcase;

a first conduit extending between said oil reservoir and a first port within said oil sleeve in fluid communication with said annular oil space, said first port being positioned so as to always be between said first and second seals regardless of the position of said piston within said cylinder bore and said oil sleeve bore;

a check valve mounted within said first conduit to prevent oil back flow from said annular oil space to said reservoir;

a second conduit extending along said wrist pin from a port in fluid communication with said annular oil space to said piston rod and along said piston rod to said crank bearing and from said crank bearing to said main bearing and then to said oil reservoir; and upon motion of said piston moving said second seal away from said first seal, lubricating oil being drawn from said oil reservoir through said first conduit and into said annular oil space to lubricate said piston, upon further motion of said piston moving said second seal toward said first seal, lubricating oil within said annular oil space being forced through said second conduit back to said oil reservoir in a closed loop circulation, thereby lubricating said wrist pin, said crank bearing and said main bearing.

33. A two-stroke, spark-ignited internal combustion engine having a piston reciprocable within a bore of a cylinder, said piston being pivotally connected to a crankshaft rotatably mounted within a sealed crankcase positioned beneath said cylinder bore, said engine comprising:

a cylinder head positioned at an end of said cylinder opposite said crankcase;

an exhaust port positioned in said cylinder between said cylinder head and said crankcase;

a scavenging port positioned in said cylinder substantially between said exhaust port and said crankcase;

a scavenging tube extending from said crankcase to said scavenging port and providing fluid communication between said crankcase and said cylinder bore;

a charging port positioned in said cylinder substantially between said scavenging port and said crankcase;

a charging tube extending from said crankcase to said charging port and providing fluid communication between said crankcase and said cylinder bore;

a fuel metering device connected to said charging tube and supplying a fuel charge thereto;

a throttle valve positioned within said charging tube, said throttle valve being adjustable to control the amount of fuel and air entering said cylinder bore;

a one-way valve positioned in said crankcase and allowing ambient air to enter;

during engine operation said exhaust port being first uncovered upon a power stroke of said piston allowing exhaust gases to exit said cylinder bore, said scavenging port being next uncovered upon further motion of said piston, air within said crankcase being compressed by said piston and forced through said scavenging tube and entering said cylinder bore through said scavenging port thereby forcing exhaust gases out through said exhaust port, said charging port being next uncovered upon further motion of said piston, air within said crankcase being further compressed by said piston and forced through said scavenging tube and said charging tube, said air flowing through said fuel metering device and receiving a charge of fuel therefrom, said air and said fuel charge entering said cylinder bore through said charging port; and upon the compression stroke of said piston ambient air being drawn into said crankcase through said one way valve, said charging port first being covered by said piston, said scavenging port being next covered by said piston, and said exhaust port being finally covered by said piston, said air and fuel charge within said cylinder bore being compressed by said piston and ignited by said sparkplug to initiate a subsequent power stroke of said piston.

34. An engine according to claim 33, further comprising an movable exhaust port valve pivotally mounted on said cylinder within said exhaust port, said exhaust port valve being pivotal between a first position partially blocking said exhaust port and thereby impeding the flow through said exhaust port, and a second position away from said exhaust port allowing unrestricted flow through said exhaust port, and a means for setting the position of said exhaust port valve in one of said first and said second positions.

35. An engine according to claim 34, wherein said setting means comprises a lever attached to said exhaust port valve for manually positioning said exhaust port valve in one of said first and second positions.

36. An engine according to claim 35, wherein said setting means further comprises a cam and a cam follower mounted on said engine, said cam being driven by said engine, said cam follower being connected to said exhaust port valve and being reciprocably movable by said cam to pivot said exhaust port valve between said first and said second positions in proportion to engine speed, said exhaust port valve being in said second position during each exhaust stroke of said piston and moving into said first position blocking said exhaust port upon each compression stroke of said piston, said exhaust port valve thereby promoting trapping of said fuel and air in said cylinder bore.

37. An internal combustion engine having a piston reciprocable within a bore of a cylinder, said piston having a piston ring and being pivotally connected to a crankshaft by a piston rod having a wrist pin at one end engaging said piston and a crank bearing at the opposite end engaging a throw of said crankshaft, said crankshaft being rotatably mounted on a main bearing within a crankcase positioned beneath said cylinder bore, an oil reservoir being mounted on said engine, said engine comprising:

an oil sleeve positioned between said cylinder and said crankcase, said oil sleeve having a bore therethrough coaxially aligned with said cylinder bore and sized to receive said piston, said piston being reciprocable within said oil sleeve bore, a first annular oil space being defined between said piston and said cylinder and a second annular oil space being defined between said piston and said oil sleeve;

a first seal positioned between said cylinder and said oil sleeve, said first seal circumferentially surrounding said piston and permitting a predetermined amount of oil to flow between said annular oil space and said cylinder bore;

a second seal mounted on and circumferentially around said piston between said wrist pin and said crankshaft, said second seal having an outer circumference engaging said oil sleeve to substantially prevent oil within said annular oil space from flowing into said crankcase;

a first conduit extending between said oil reservoir and a first port within said cylinder, said first port being positioned so as to always be between said first seal and said oil ring regardless of the position of said piston within said cylinder bore;

a check valve mounted within said first conduit to prevent oil back flow from said cylinder to said reservoir;

a second conduit extending through said piston from a second port in fluid communication with said second annular oil space to said wrist pin; and upon motion of said piston moving said piston ring away from said first seal, lubricating oil being drawn from said oil reservoir through said first conduit and into said first annular oil space between said piston and said cylinder to lubricate said piston, upon further motion of said piston moving said cylinder ring toward said first seal, lubricating oil within said first annular oil space being forced past said first seal into said second annular oil space between said piston and said sleeve, and further through said second conduit, thereby lubricating said wrist pin.

38. An engine according to claim 37, wherein said second conduit extends along said piston rod to said crank bearing, said crank bearing being lubricated by said oil from said second annular oil space passing through said second conduit.

39. An engine according to claim 38, wherein said second conduit extends along said crankshaft to said main bearing, said main bearing being lubricated by said oil from said second annular oil space passing through said second conduit.

40. An engine according to claim 39, wherein said second conduit extends from said main bearing to said oil reservoir, oil from said second annular oil space being forced through said second conduit back to said reservoir in a closed loop circulation.

41. A method of operating a spark-ignited, two-stroke engine having a piston reciprocable within a bore of a cylinder mounted on a crankcase, said cylinder having a spark plug, an exhaust port, a scavenging port, a charging port connected to the crankcase by a charging tube, a fuel metering system and a throttle valve positioned within the charging tube, said method comprising the steps of:

opening said exhaust port upon a power stroke of said piston allowing exhaust gases to exit said cylinder bore;

opening said scavenging port upon further motion of said piston;

forcing air through said scavenging port into said cylinder bore;

opening said charging port upon further motion of said piston;

forcing air through said fuel metering device in said charging tube;

charging said air forced through said fuel metering device with fuel;

forcing said air charged with fuel into said cylinder bore through said charging port;

throttling said air forced through said charging port with said throttle valve in said charging tube;

closing said charging port upon a compression stroke of said piston;

closing said scavenging port upon further motion of said piston; and closing said exhaust port upon further motion of said piston, said air and fuel charge within said cylinder bore being compressed by said piston and ignited by said sparkplug to initiate a subsequent power stroke of said piston.

42. A method according to claim 41, further comprising the step of metering fuel to provide a rich fuel mixture within said cylinder bore.

43. A method according to claim 41, wherein said engine further comprises a crankcase substantially free of lubricating oil, said method further comprising the steps of:

providing a scavenging tube from said crankcase to said scavenging port;

providing a charging tube between said crankcase and said charging port;

said step of forcing said air through said scavenging port comprising the step of compressing air in said crankcase with said piston, thereby forcing said air through said scavenging tube into said cylinder bore; and said step of forcing said air through said charging port comprising the step of compressing air in said crankcase with said piston, thereby forcing said air through said charging tube into said cylinder bore.

44. An internal combustion engine having a piston reciprocable within a bore of a cylinder, said piston having a piston ring and being pivotally connected to a crankshaft by a piston rod having a wrist pin at one end engaging said piston and a crank bearing at the opposite end engaging a throw of said crankshaft, said crankshaft being rotatably mounted on a main bearing within a crankcase positioned beneath said cylinder bore, an oil reservoir being mounted on said engine, said engine comprising:

an annular oil space being defined between said piston and said cylinder;

a first seal positioned between said cylinder and said crankcase, said first seal circumferentially surrounding said piston and substantially preventing oil from entering said crankcase from said annular oil space;

a first conduit extending between said oil reservoir and a first port within said cylinder, said first port being positioned so as to always be between said first seal and said piston ring regardless of the position of said piston within said cylinder bore;

a check valve mounted within said first conduit to prevent oil back flow from said annular oil space to said reservoir;

a second conduit extending from a second port in fluid communication with said annular oil space through said piston to said wrist pin; and upon motion of said piston moving said piston ring away from said first seal, lubricating oil being drawn from said oil reservoir through said first conduit and into said annular oil space between said piston and said cylinder to lubricate said piston, upon further motion of said piston moving said cylinder ring toward said first seal, lubricating oil within said annular oil space being forced through said second conduit thereby lubricating said wrist pin.

45. An engine according to claim 44, wherein said second conduit extends along said piston rod to said crank bearing, and upon further motion of said piston moving said cylinder ring toward said first seal, lubricating oil within said annular oil space being forced through said second conduit thereby lubricating said crank bearing.

46. An engine according to claim 45, wherein said second conduit extends along said crankshaft to said main bearing, and upon further motion of said piston moving said cylinder ring toward said first seal, lubricating oil within said annular oil space being forced through said second conduit thereby lubricating said main bearing.

47. An engine according to claim 46, wherein said second conduit extends from said main bearing to said reservoir, and upon further motion of said piston moving said cylinder ring toward said first seal, lubricating oil within said annular oil space being forced through said second conduit back to said oil reservoir in a closed loop circulation, thereby lubricating said wrist pin, said crank bearing and said main bearing.

48. An internal combustion engine having a piston reciprocable within a bore of a cylinder, said piston being pivotally connected to a crankshaft by a piston rod having a wrist pin at one end engaging said piston and a crank bearing at the opposite end engaging a throw of said crankshaft, said crankshaft being rotatably mounted on a main bearing within a crankcase positioned beneath said cylinder bore, an oil reservoir being associated with said engine, said engine comprising:

an oil sleeve positioned between said cylinder and said crankcase, said oil sleeve having a bore therethrough coaxially aligned with said cylinder bore and sized to receive said piston, said piston being reciprocable within said oil sleeve bore, an annular oil space being defined between said piston and said oil sleeve;

a first seal positioned between said cylinder and said oil sleeve, said first seal circumferentially surrounding said piston and permitting a predetermined amount of oil to flow from said annular oil space to said cylinder bore for lubricating said piston within said cylinder;

a second seal mounted on and circumferentially around said piston between said wrist pin and said crankshaft, said second seal having an outer circumference engaging said oil sleeve to substantially prevent oil within said annular oil space from flowing into said crankcase;

a first conduit extending between said oil reservoir and a first port within said oil sleeve in fluid communication with said annular oil space, said first port being positioned so as to always be between said first and second seals regardless of the position of said piston within said cylinder bore and said oil sleeve bore; and upon motion of said piston moving said second seal away from said first seal, lubricating oil being drawn from said oil reservoir through said first conduit and into said annular oil space to lubricate said piston, upon further motion of said piston moving said second seal toward said first seal said predetermined amount of lubricating oil within said annular oil space being forced past said first seal to said cylinder bore for lubricating said piston within said cylinder.

49. An engine according to claim 48, further comprising:

a check valve mounted within said first conduit to prevent oil back flow from said annular oil space to said reservoir;

a second conduit extending through said piston from a second port in fluid communication with said annular oil space to said wrist pin; and upon motion of said piston moving said second seal toward said first seal, lubricating oil within said annular oil space being forced through said second conduit to lubricate said wrist pin.

50. An engine according to claim 49, wherein said second conduit extends from said wrist pin along said piston rod to said crank bearing, and upon motion of said piston moving said second seal toward said first seal, lubricating oil within said annular oil space being forced through said second conduit lubricating said crank bearing.

51. An engine according to claim 50, wherein said second conduit extends from said crank bearing along said crankshaft to said main bearing, and upon motion of said piston moving said second seal toward said first seal, lubricating oil within said annular oil space being forced through said second conduit lubricating said main bearing.

52. An engine according to claim 51, wherein said second conduit extends from said main bearing to said reservoir, and upon motion of said piston moving said second seal toward said first seal, lubricating oil within said annular oil space being forced through said second conduit back to said oil reservoir in a closed loop circulation, thereby lubricating said wrist pin, said crank bearing and said main bearing.

* * * * *

UNITED STATES PATENT AND TRADEMARK OFFICE

CERTIFICATE OF CORRECTION

PATENT NO. : 6,397,795 B2
DATED : June 4, 2002
INVENTOR(S) : Hare

It is certified that error appears in the above-identified patent and that said Letters Patent is hereby corrected as shown below:

Title page,
Item [76], Inventor, change "177 Pineview Rd." to -- 177 Pineville Rd. --

Signed and Sealed this

Twelfth Day of November, 2002

*Attest:*

*Attesting Officer*

JAMES E. ROGAN
*Director of the United States Patent and Trademark Office*